US008430499B2

(12) United States Patent
Usuda et al.

(10) Patent No.: US 8,430,499 B2
(45) Date of Patent: Apr. 30, 2013

(54) PRINTING APPARATUS AND PRINTING METHOD

(75) Inventors: Hidenori Usuda, Matsumoto (JP); Shinichi Kamoshida, Shiojiri (JP); Mitsuaki Yoshizawa, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 133 days.

(21) Appl. No.: 12/729,133

(22) Filed: Mar. 22, 2010

(65) Prior Publication Data

US 2010/0238211 A1 Sep. 23, 2010

(30) Foreign Application Priority Data

Mar. 23, 2009 (JP) ..... 2009-070613

(51) Int. Cl.
*B41J 2/01* (2006.01)

(52) U.S. Cl.
USPC ..... 347/101

(58) Field of Classification Search ..... 347/101
See application file for complete search history.

(56) References Cited

U.S. PATENT DOCUMENTS

| | | | | |
|---|---|---|---|---|
| 6,902,249 | B2 | 6/2005 | Suzuki et al. | |
| 2006/0158481 | A1 * | 7/2006 | Spevak et al. | 347/43 |
| 2008/0218539 | A1 * | 9/2008 | Hill et al. | 347/7 |

FOREIGN PATENT DOCUMENTS

| | | | |
|---|---|---|---|
| JP | 2003-285422 | A | 10/2003 |
| JP | 2003-285427 | A | 10/2003 |
| JP | 2007-182074 | A | 7/2007 |
| WO | 97/15453 | A1 | 5/1997 |
| WO | 98/17480 | A1 | 4/1998 |

* cited by examiner

*Primary Examiner* — Geoffrey Mruk
(74) *Attorney, Agent, or Firm* — Kilpatrick Townsend & Stockton LLP

(57) ABSTRACT

An apparatus for printing an image on a transparent medium based on a selected mode, the apparatus includes: a head that ejects ink droplets from nozzles, wherein when a first mode is selected, the head prints a first image on the transparent medium, prints a background image on the first image, and prints a second image which is different from the first image on the background image, and wherein when a second mode is selected, the head prints a second image on the transparent medium, prints a background image on the second image, and prints a first image on the background image.

13 Claims, 24 Drawing Sheets

PRINTING APPARATUS AND PRINTING METHOD

BACKGROUND

1. Technical Field

The present invention relates to a printing apparatus and a printing method which ejects ink droplets from nozzles of a head to print an image on a medium.

2. Related Art

There has been known an ink jet printer as a printing apparatus. The printer ejects ink droplets towards a medium from nozzles of a head to print an image on the medium.

As such a medium, a transparent medium, such as a transparent film, that is, a medium, of which an opposite side is visible through the medium, is used. JP-A-2003-285422 discloses a printer capable of switching between 'a front-side print mode', in which a white background image is printed on the transparent medium, and then an objective image is overlapped on the background image, and 'a back-side print mode', in which an objective image is printed on a transparent medium, and then a white background image is overlapped on the objective image.

However, according to the printer disclosed in JP-A-2003-285422, the objective image is formed on only one surface of the background image, that is, the other surface of the background image remains as a solid color (i.e., a field of the background image) on which an image is not formed. For this reason, there is the drawback in that the amount of information added to the transparent medium is small.

In this regard, if a first image and a second image are formed on each surface of the background image as an objective image, the amount of information added to the transparent medium is approximately doubled.

In this instance, however, either of the first image or the second image is viewable through the transparent image, and the preferential viewing order of the images through which the transparent medium varies depending upon the purpose or intended usage of the printed record. Accordingly, it is convenient if the image which is seen through the transparent medium can be selected.

SUMMARY

An advantage of some aspects of the invention is to provide a printing apparatus and a printing method which can increase the amount of information to be added to a medium, referred to as a transparent medium, through which the opposite side is viewable, and can select which of a first image and a second image to be formed on the medium is seen through the medium.

According to an aspect of the invention, there is provided an apparatus for printing an image on a transparent medium based on a selected mode, the apparatus including a head that ejects ink droplets from nozzles, wherein when a first mode is selected, the head prints a first image on the transparent medium, prints a background image on the first image, and prints a second image which is different from the first image on the background image, and wherein when a second mode is selected, the head prints a second image on the transparent medium, prints a background image on the second image, and prints a first image on the background image.

Other characteristics of the invention will be apparent from the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
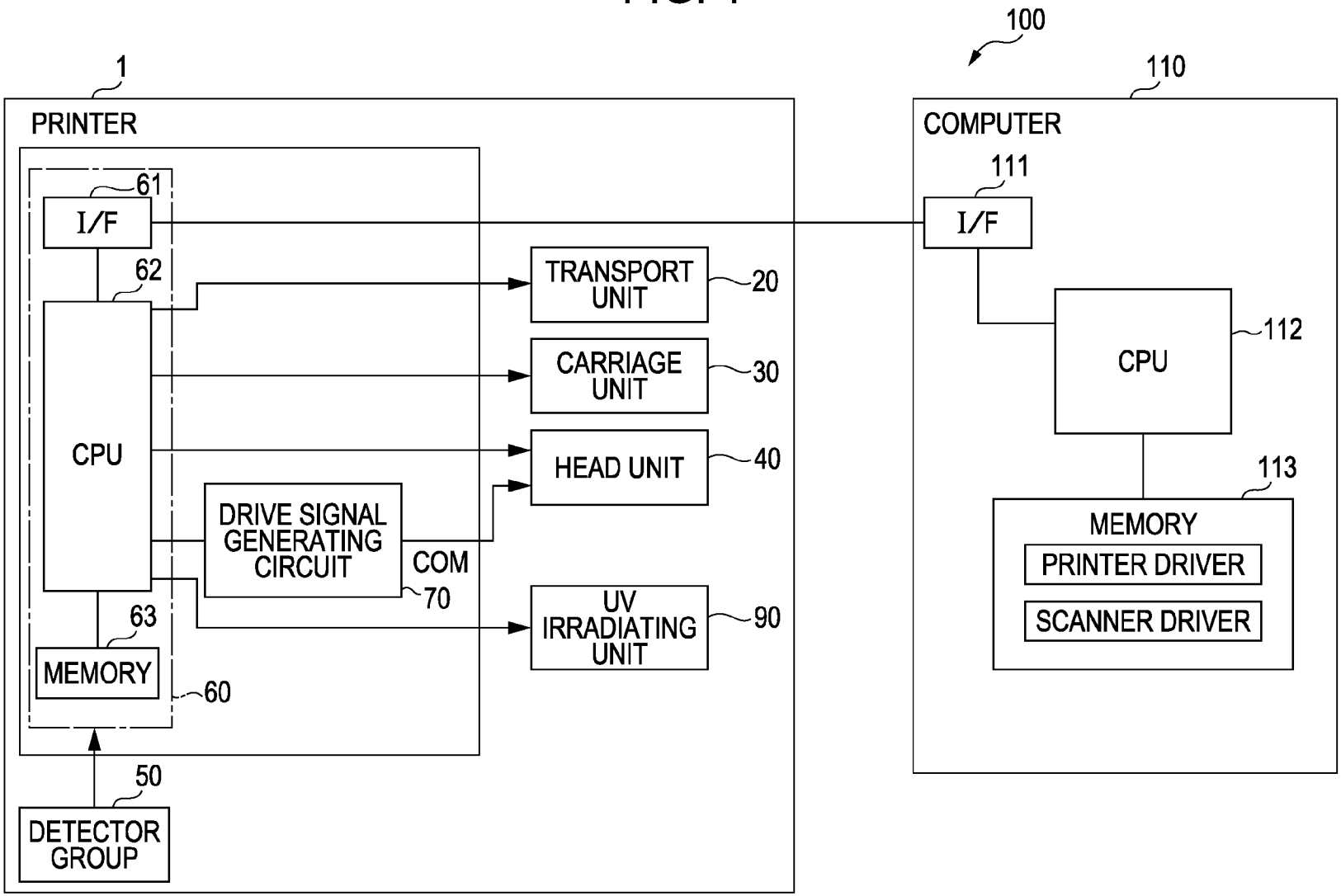
FIG. 1 is a block diagram showing the configuration of a print system.

The following points will be apparent from at least the specification and the accompanying drawings.

According to an aspect of the invention, there is provided an apparatus for printing an image on a transparent medium based on a selected mode, the apparatus including a head that ejects ink droplets from nozzles, wherein when a first mode is selected, the head prints a first image on the transparent medium, prints a background image on the first image, and prints a second image which is different from the first image on the background image, and wherein when a second mode is selected, the head prints a second image on the transparent medium, prints a background image on the second image, and prints a first image on the background image.

With the above description, the printing apparatus and the printing method can increase the amount of information to be added to a medium, referred to as a transparent medium, through which the opposite side is viewable, and can select which of a first image and a second image to be formed on the medium is seen through the medium.

In the printing apparatus, it is preferable that in the first mode, a mirror image of the first image is printed, and simultaneously, an actual image of the second image is printed, and that in the second mode, a mirror image of the second image is printed, and simultaneously, an actual image of the first image is printed. Further, the first image is an additive image having an area of printing which is smaller than that of the second image. It is preferable that the first mode is a front-beat print mode in which the second image is positioned closer to the head than the additive image in a printing completion state, and the second mode is a back-beat print mode in which the additive image is positioned closer to the head than the second image in the printing completion state. Further, it is preferable that print resolution of the additive image is lower than that of image at other side. In addition, it is preferable that the head include a nozzle for ejecting the ink droplets of a predetermined background color in order to print the background image with the predetermined background color.

It is preferable that the printing apparatus further includes a transport unit that transports the transparent medium in a transport direction; the head is guided in a moving direction intersecting with the transport direction; the plurality of nozzles are installed to the head along the transport direction; the image is printed by repeating a transport operation in which the transparent medium is transported in the transport direction by the transport unit, and a dot formation operation in which the ink droplets are ejected from the nozzles to form dots on the transparent medium while the head is moved in the moving direction; and the resolution is resolution in the transport direction. Further, the printing apparatus further includes a moving mechanism that moves a relative position of the transparent medium and the head in a direction intersecting with a nozzle line direction in which the nozzles are arranged in parallel with each other.

With the above description, the printing apparatus and the printing method can increase the amount of information to be added to the medium, referred to as a transparent medium, through which the opposite side is seen, and can select which of the first image and the second image to be formed on the medium is seen through the medium.

According to another aspect of the invention, there is provided a method for printing an image on a transparent image based on a selected mode by a head that ejects ink droplets from nozzles, wherein when a first mode is selected, the head prints a first image on the transparent medium, prints a background image on the first image, and prints a second image which is different from the first image on the background image, and wherein when a second mode is selected, the head prints a second image on the transparent medium, prints a background image on the second image, and prints a first image on the background image.

With the above description, the printing apparatus and the printing method can increase the amount information to be added to a medium, referred to as a transparent medium, through which the opposite side is seen, and can select which of a first image and a second image to be formed on the medium is seen through the medium.

FIRST EMBODIMENT

As to a Printer System

FIG. 1 is a block diagram showing the configuration of the print system 100. The print system 100 of the embodiment is a system including a printer 1 and a computer 110, as shown in FIG. 1.

The printer 1 is a printing apparatus which forms (prints) an image on a medium by ejecting ink on the medium, and is a color ink jet printer of a serial type in this embodiment. The printer 1 can print the image on plural kinds of media, such as a film sheet S. The configuration of the printer 1 will be described below.

The computer 110 includes an interface 111, a CPU 112, and a memory 113. The interface 111 performs transmission and reception of data between the printer 1 and the computer 110. The CPU 112 performs the overall controlling of the computer 110 to execute various programs installed in the computer 110. The memory 113 stores various programs or various data. Among the programs installed in the computer 110, there is a printer driver for converting image data output from an application program into print data. The computer 110 outputs the print data created by the printer driver to the printer 1.

Construction of the Printer

Figure 2A:
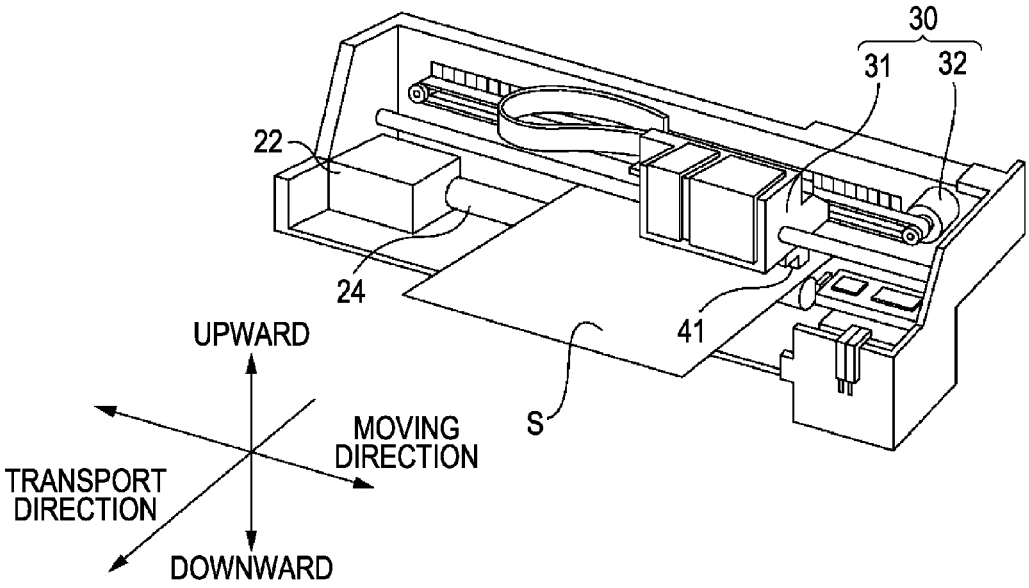
FIG. 2A is a perspective view of the overall configuration of a printer.
Figure 2B:
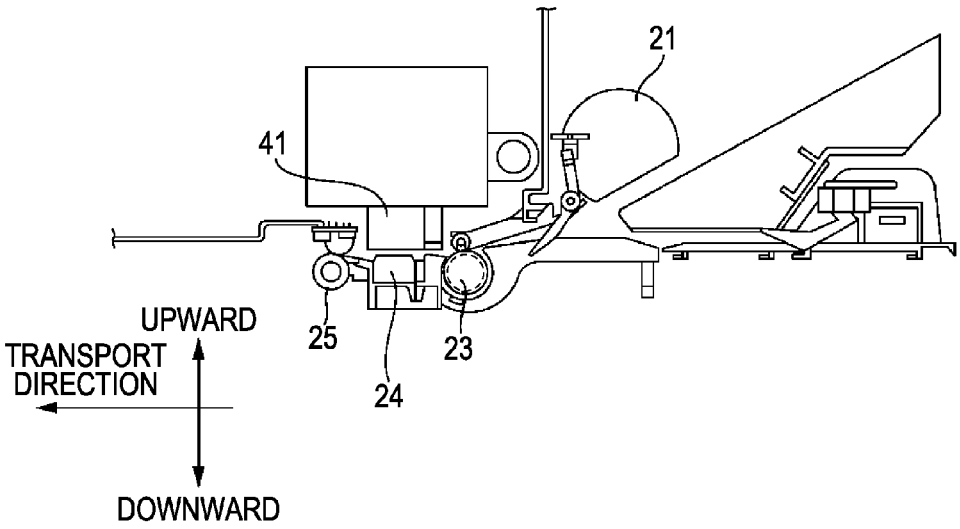
FIG. 2B is a cross-sectional view of the overall configuration of the printer.

FIG. 2A is a perspective view of the overall configuration of the printer 1, and FIG. 2B is a cross-sectional view of the overall configuration of the printer 1.

The printer 1 includes a transport unit 20, a carriage unit 30, a head unit 40, a detector group 50, a controller 60, a drive signal generating circuit 70, and a UV irradiation unit 90.

With the printer 1, the respective units (the transport unit 20, the carriage unit 30, the head unit 40, the drive signal generating circuit 70 and the UV irradiation unit 90) are controlled by the controller 60. The controller 60 controls the respective units based on the print data received from the computer 110 and prints the image on a transparent medium such as the film sheet S. Here, the film sheet used in this embodiment is a sheet through which an opposite side is seen. In this instance, the transparent medium according to the embodiment may be a translucent medium or a see-through medium.

The transport unit 20 is configured to transport the film sheet S in a predetermined direction (hereinafter, referred to as a transport direction). The transport unit 20 includes a paper feed roller 21, a transport motor 22, a transport roller 23, a platen 24, and a paper ejection roller 25. The paper feed roller 21 is a roller for feeding the film sheet S which is inserted in a medium insertion opening to the printer. The transport roller 23 is a roller for transporting the film sheet S fed by the paper feed roller 21 to a printable region, and is driven by the transport motor 22. The platen 24 supports the film sheet S which is being printed on. The paper ejection roller 25 is a roller for ejecting the film sheet S outwardly from the printer, and is installed at a downstream side of the printable region in the transport direction. The paper ejection roller 25 is rotated synchronous with the transport roller 23.

The carriage unit 30 is configured to move the head in a predetermined direction (hereinafter, referred to as a moving direction). The carriage unit 30 includes a carriage 31 and a carriage motor 32. The carriage 31 is reciprocated in the moving direction, and is driven by the carriage motor 32. The carriage 31 detachably holds an ink cartridge accommodating ink therein.

The head unit 40 is configured to eject the ink on the film sheet. The head unit 40 has a head 41 with a plurality of nozzles. Since the head 41 is installed on the carriage 31 as the head unit 40, when the carriage 31 moves in the moving direction, the head 41 also moves in the moving direction. As the head 41 ejects the ink intermittently while moving in the moving direction, a dot line (i.e., a raster line) is formed on the film sheet S along the moving direction. The configuration of the head will be described below.

The detector group 50 includes various detectors that detects information on the respective units of the printer 1 and sends it to the controller 60.

The controller 60 is a control unit that performs the controlling of the printer. The controller 60 includes an interface portion 61, a CPU 62, and a memory 63. The interface portion 61 performs transmission and reception of data between the printer 1 and the computer 110 which is a peripheral device. The CPU 62 is an operation processing device for performing the controlling of the overall printer. The memory 63 is to ensure a region for storing programs of the CPU 62 and an operation region, and has a memory element such as RAM or EEPROM. The CPU 62 controls the respective units according to the programs stored in the memory 63.

The drive signal generating circuit 70 generates the drive signal which is applied to a piezoelectric element, which will be described below, installed in the head to eject ink droplets. The drive signal generating circuit 70 includes a DAC (not shown). The drive signal generating circuit 70 generates an analog voltage signal based on digital data on a waveform of the drive signal out from the controller 60. Further, the drive signal generating circuit 70 also includes an amplifier circuit (now shown) for power amplifying the generated voltage signal to generate a drive signal.

The UV irradiation unit 90 is a device for irradiating ultraviolet rays on the above-described UV curable type ink to cure the ink. In this embodiment, the UV irradiation unit 90 includes an LED, and is installed on the head 41. If the carriage unit 30 moves the head 41, the UV irradiation unit is also moved in the moving direction of the head 41. Further, intensity of UV irradiation of the UV irradiation unit 90 is controlled by the controller 60.

Figure 3:
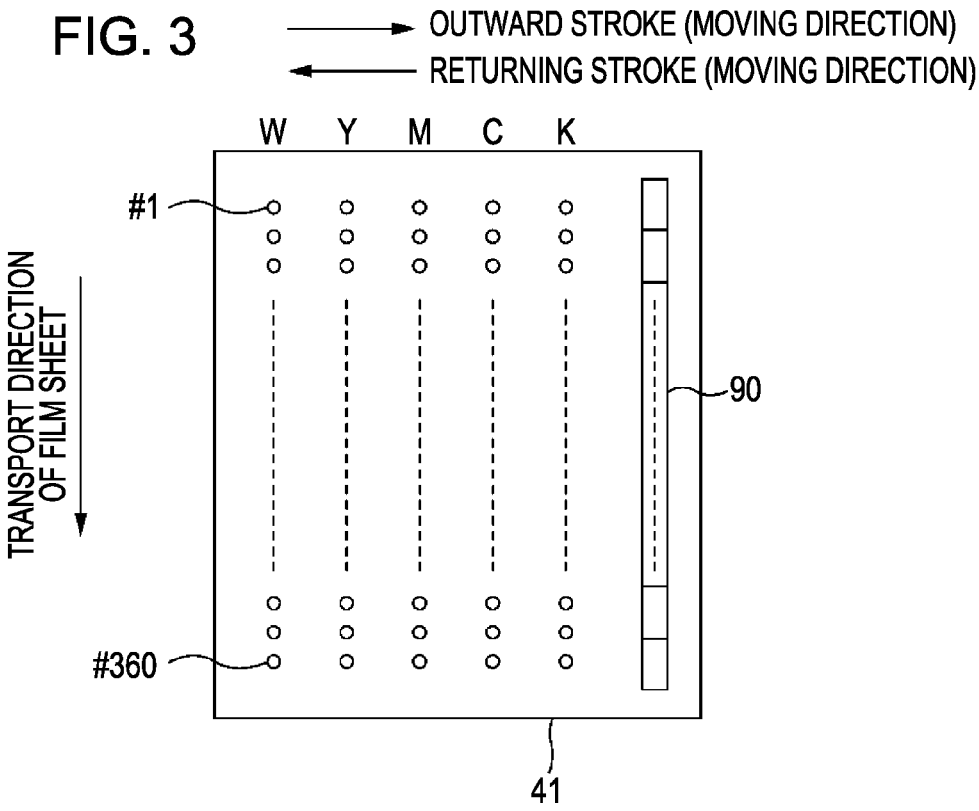
FIG. 3 is a view illustrating a nozzle array in a head of a head unit.

FIG. 3 is a view illustrating the nozzle array in the head 41 of the head unit 40. Here, although the nozzle array can be seen from only a bottom thereof, the nozzle array is shown to be observed from a top in order to easily illustrate the nozzle array.

The head 41 includes a black ink nozzle array NK, a cyan ink nozzle array NC, a magenta ink nozzle array NM, a yellow ink nozzle array NY, and a white ink nozzle array NW. Each of the nozzle arrays has a plurality of nozzles (in this embodiment, 360) for ejecting the ink. Plural nozzles of the respective nozzle arrays are arranged in the transport direction of the film sheet S at a predetermined pitch (in this embodiment, 360 dpi).

Further, the head 41 is provided with a UV irradiation unit 90 for curing UV curable ink. The UV irradiation unit 90 includes an LED which can irradiate ultraviolet rays.

Since the UV irradiation unit 90 is installed, formation of dots is performed in an outward stroke of the head 41 in the moving direction, while ultraviolet rays are irradiated on the dots in a returning stroke. The dots formed in the outward stroke are cured in the returning stroke of the head 41.

Figure 4:
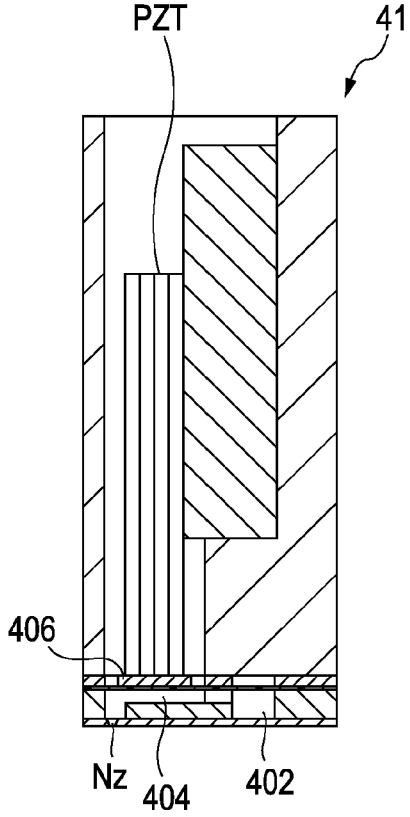
FIG. 4 is a view illustrating the structure of a head.

FIG. 4 is a view illustrating the configuration of the head. In the figure, a nozzle Nz, a piezoelectric element PZT, an ink supply passage 402, a nozzle communication passage 404, and a resilient plate 406 are shown.

The ink supply passage 402 is supplied with the ink from an ink tank (now shown), and then the ink is supplied to the nozzle communication passage 404. The piezoelectric element PZT is applied by a drive pulse of the drive signal which will be described below. If the drive pulse is applied, the piezoelectric element PZT is expanded and contracted in response to the signal of the drive pulse, and thus a resilient plate 406 is vibrated. The ink droplets of an amount corresponding to the amplitude of the drive pulse are ejected from the nozzle Nz.

Figure 5:
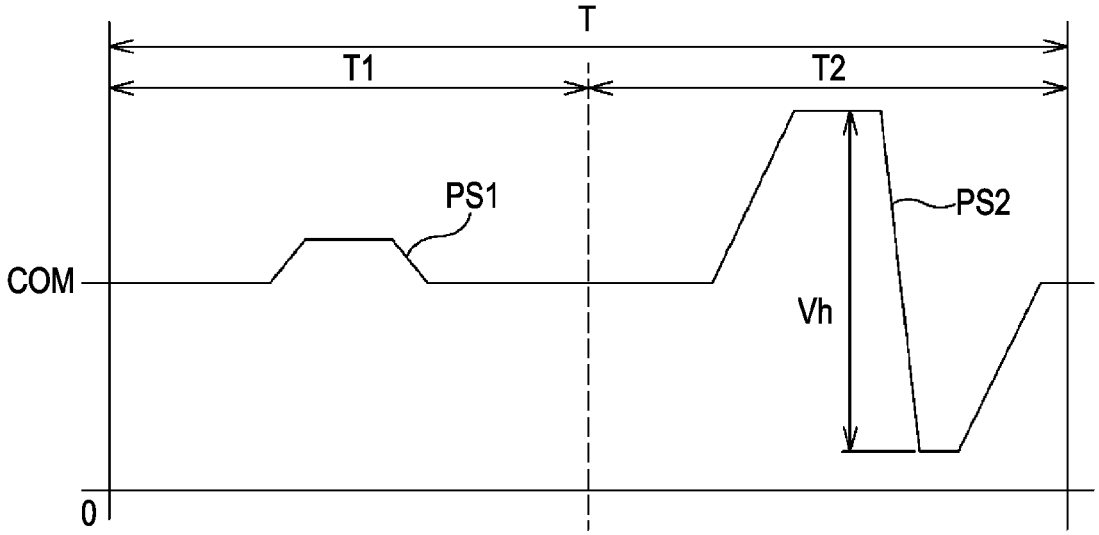
FIG. 5 is a view illustrating a drive signal.

FIG. 5 is a view illustrating a drive signal COM. The drive signal COM is repeatedly generated every a repetition period T. The repetition period, i.e., a time period T, corresponds to a time period during movement of the head every one pixel on the film sheet S. For example, in the case in which the print resolution of the head in the moving direction is 360 dpi, the time period T corresponds to a time period while the head moves by 1/360 inch. If a micro vibration pulse PS1 or drive pulse PS2 of each time period which is contained in the time period T is applied to the piezoelectric element PZT based on pixel data contained in the print data, the dots can be formed in one pixel, or the dots cannot be formed.

The drive signal COM has a micro vibration pulse PS1 and a drive pulse PS2 which are generated at a time period T1 of the repetition period. The micro vibration PS1 is a pulse for micro-vibrating an ink surface (ink meniscus) of the nozzle. In this case in which the pulse is applied, the ink is not ejected from the nozzle. The drive pulse PS2 is a drive pulse for ejecting the ink from the nozzle. In the case in which the pulse is applied, the ink is ejected from the nozzle.

In the figure, Vh is displayed as amplitude of the drive pulse PS2. If the amplitude is large, ink droplets of a large size are ejected, while if the amplitude is small, ink droplets of a small size are ejected.

Figure 6:
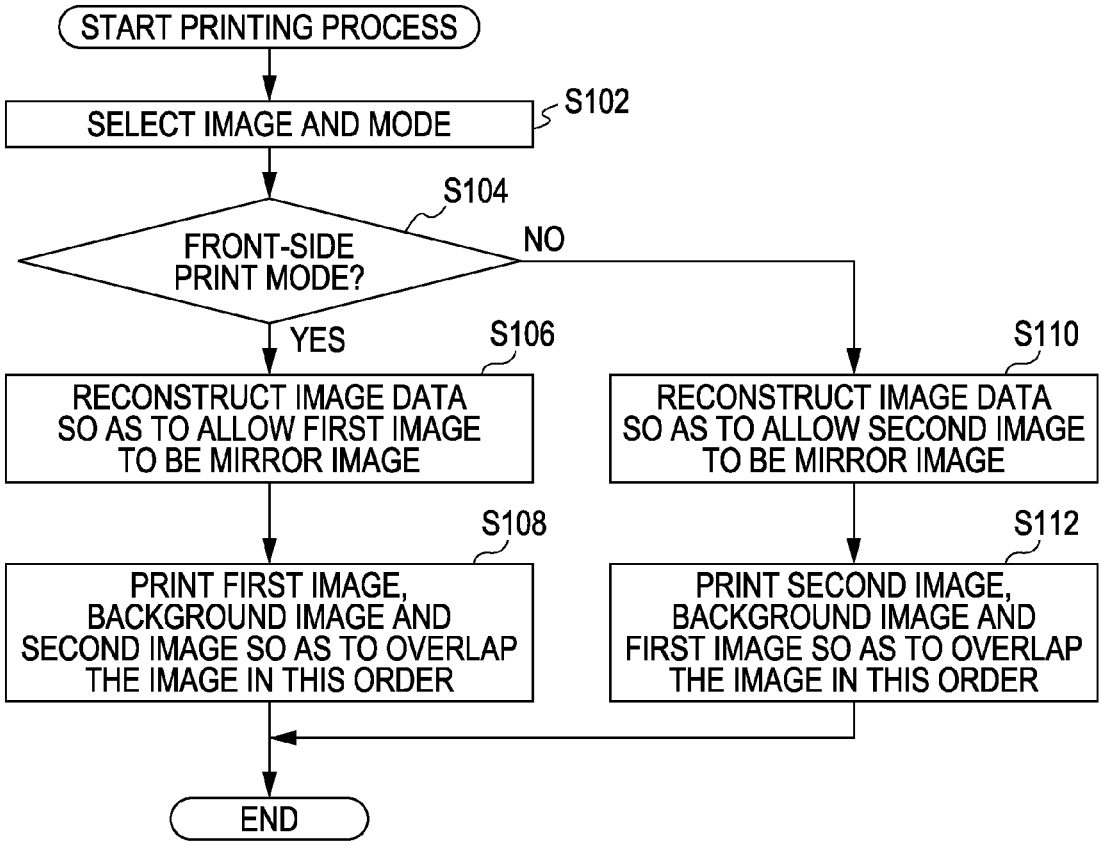
FIG. 6 is a flowchart illustrating a printing process according to a first embodiment.

FIG. 6 is a flowchart illustrating a printing process according to the first embodiment.

First, selection of the image to be printed and selection of a print mode are performed (S102). Two images to be printed are selected, in which one is a first image and the other is a second image. Further, there are two print modes, that is, a front-side print mode and a back-side print mode which are described below. Here, an image to be printed as the first image and an image to be printed as the second image are selected through a user interface of the computer 110. Moreover, either of the front-side print mode or the back-side print mode is selected through the user interface.

Next, it is determined whether the front-side print mode is selected or the back-side print mode is selected (S104). In the case in which the front-side print mode is selected, the step S106 is executed, while in the case in which the back-side print mode is selected, the step S110 is executed.

In the case in which the front-side print mode is selected, the image data is reconstructed so as to allow the first image to be a mirror image.

Figure 7A:
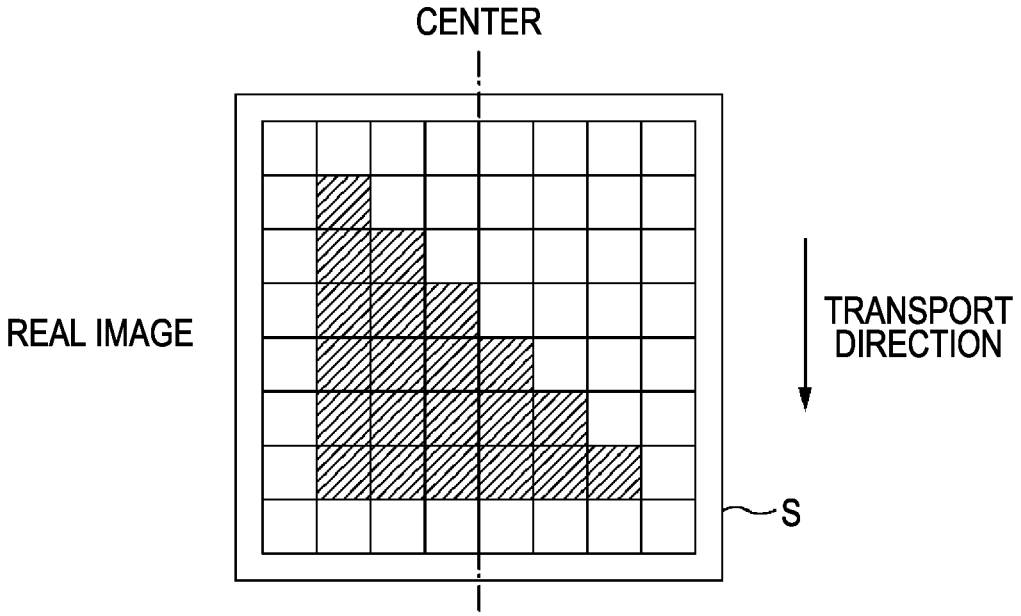
FIGS. 7A and 7B are views illustrating a mirror image for an actual image.
Figure 7B:
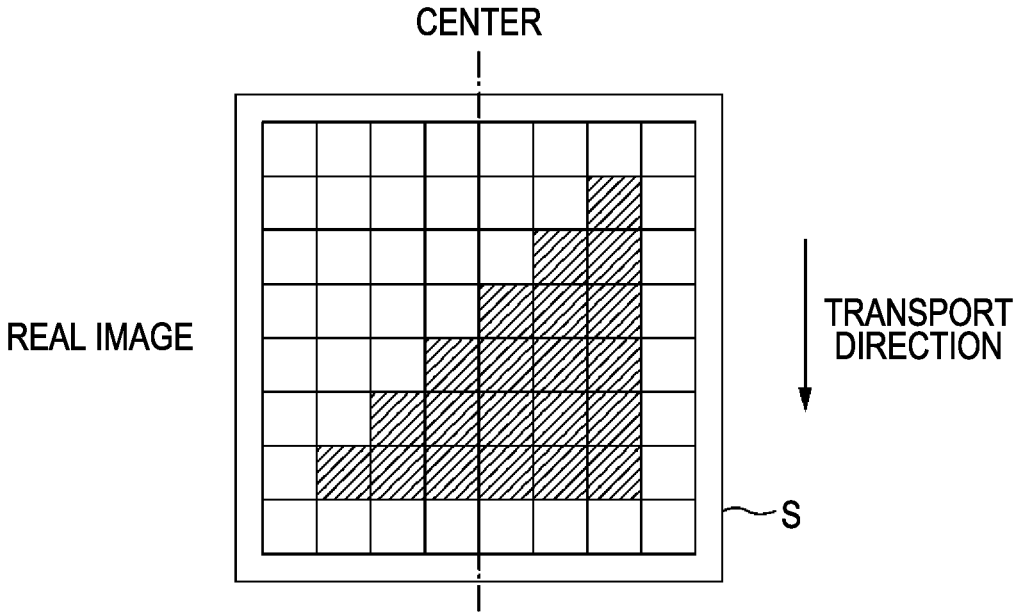

FIG. 7A is a view illustrating an actual image, and FIG. 7B is a view illustrating a mirror image for the actual image. In each figure, pixels on which dots are formed are shown, and the pixels on which the dots are formed are hatched. In this instance, for descriptive convenience, the decreased number of pixels is shown on the film sheet S to be printed.

In this embodiment, when the image data of the actual image is converted into the image data of the mirror image, the image data is reconstructed as an image which can be reversed in right and left directions around a center of the film sheet S in a widthwise direction. Comparing FIG. 7A and FIG. 7B, the dots to be formed are replaced with others around the center of the film sheet S in a widthwise direction. In this way, the image data of the actual data is reconstructed to be the image data of the mirror image.

Next, the printing is performed in such a way that the first image, the background image and the second image are overlapped on the film sheet S in this order.

Figure 8:
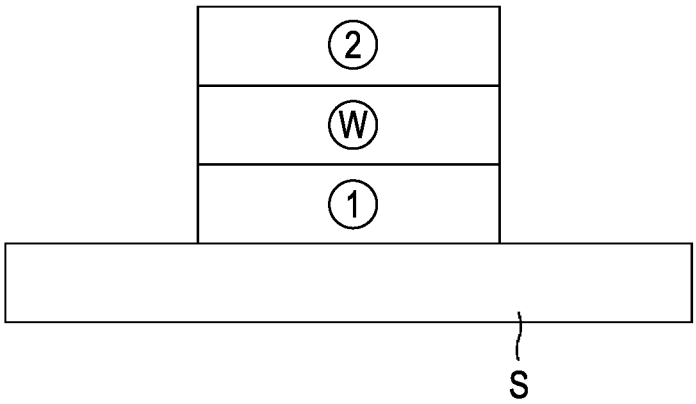
FIG. 8 is a view illustrating an overlapping order of ink in a front-side print mode.

FIG. 8 is a view illustrating an overlapping order of ink in the front-side print mode. In the figure, the order of the dots which are formed so as to be overlapped on the film sheet S is shown. As shown in the figure, the first image (the mirror image) is formed on the film sheet S, white ink is painted over the first image as the background image, and the second image (the actual image) is formed on the painted white ink.

In this way, since the first image and the second image which are different from each other are printed, with the background image (the white ink) being interposed therebetween, the amount of information loaded to the film sheet by the images can be approximately doubled. Also, it is possible to save the film sheet itself and a space for installing the film sheet.

At step S104, in the case in which the back-side print mode is selected, the image data is reconstructed in such a way that the second image becomes the mirror image. The method for reconstructing the mirror image as the image data is identical to the above-described method shown in FIG. 7.

Next, the printing is performed in such a way that the second image, the background image and the first image are overlapped on the film sheet S in this order.

Figure 9:
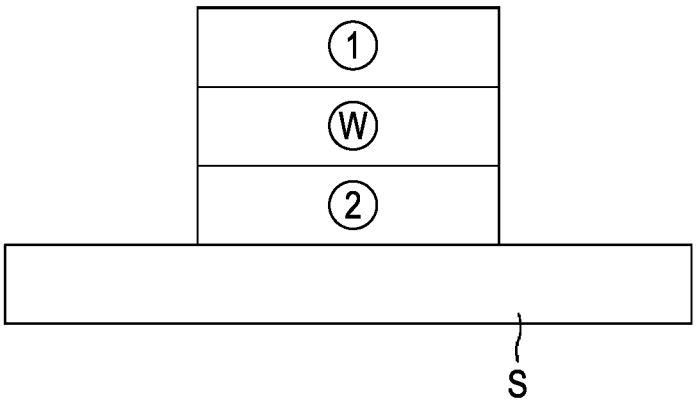
FIG. 9 is a view illustrating an overlapping order of ink in a back-side print mode.

FIG. 9 is a view illustrating the overlapping order of the ink in the back-side print mode. In the figure, the order of the images formed to be overlapped on the film sheet S is shown. As shown in the figure, the second image (the mirror image) is formed on the film sheet S, the white ink is painted over the second image as the background image, and then the first image (the actual image) is formed on the painted white ink.

In this way, when the front-side print mode (corresponding to the first mode) is selected, since the first image is printed on the film sheet S, it is possible to fabricate a printed record in which the first image is seen through the film sheet S. By contrast, when the back-side print mode (corresponding to the second mode) is selected, since the second image is printed on the film sheet S, it is possible to fabricate a printed record in which the second image is seen through the film sheet S. Consequently, it is possible to easily select the image which is seen through the film sheet S, by performing the mode selection in accordance with a use purpose or intended usage of the printed record, thereby enhancing the convenience.

In this instance, the first image may be additional information about the printing record, and the second image may be an image of the objective printed record. Further, as the additional information, the first image can be information on the second image, for example, a print lot number. In addition, as the additional information, the first image can be an image for advertisement.

Further, a magnitude relation of abrasion resistance between the first image and the second image can be changed by the above-described mode selection. That is, if the front-side print mode is selected, since the first image is printed on the film sheet S, the first image can be seen through the film sheet S. Therefore, it is possible to fabricate the printed record having the first image of increased abrasion resistance in comparison with the second image. By contrast, if the back-side print mode is selected, since the second image is printed on the film sheet S, the second image can be seen through the film sheet S. Therefore, it is possible to fabricate the printed record having the second image of increased abrasion resistance in comparison with the first image.

In the first embodiment, the operation of the head of the printer 1 which achieves the front-side print mode and the back-side print mode will now be described.

Figure 10:
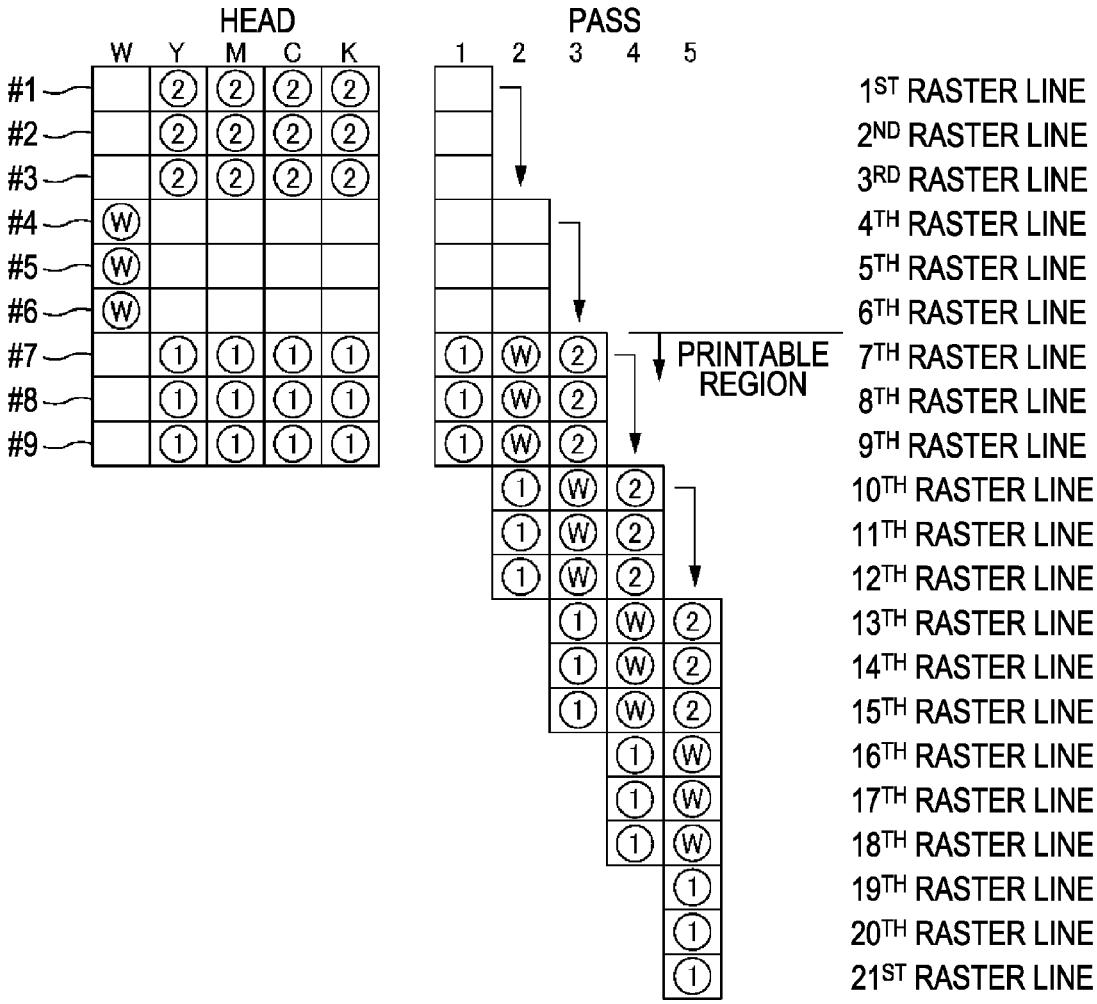
FIG. 10 is a view illustrating band print according to the first embodiment.

FIG. 10 is a view illustrating the band print according to the first embodiment. In the figure, the head including the nozzle arrays of white W, yellow Y, magenta M, cyan C and black K is shown. Here, for descriptive convenience, each of the nozzle arrays has 9 nozzles which are indicated by first to ninth nozzle numbers. Further, at the right side of the head, each of the passes is shown to indicate which side the nozzle forms the dots in a raster line.

Referring again to FIG. 8, the layer forming the first image is indicated by a symbol '1', the layer forming the second image is indicated by a symbol '2', and the layer forming the background image by the white ink is indicated by a symbol 'W', in which reference numerals are enclosed by a circle, respectively. In the figure, corresponding to the symbols, the nozzle forming the first image is indicated by '1', the nozzle forming the second image is indicated by '2', and the nozzle forming the background image by the white ink is indicated by 'W'. In this instance, nozzles which are not indicated by any symbols are unused nozzles.

In addition, at the respective passes, the nozzle forming dots of the first image is indicated by '1', the nozzle forming dots of the second image is indicated by '2', and the nozzle forming dots of the background image by the white ink is indicated by 'W'.

Referring to the figure, the printable region exists after the $7^{th}$ raster line. For example, at the first pass, in the $7^{th}$ raster line to the $9^{th}$ raster line, the dots of the first image are formed on the film sheet S by the seventh to ninth nozzles of YMCK at the first pass. Here, whenever one pass is completed, the film sheet S is transported by three nozzle pitches in the transport direction. In the figure, in order to show that the film sheet S is relatively moved in the transport direction, the position of the raster line which forms the dots is shown to be moved as an arrow in the figure.

At the second pass, the dots of the background image are formed on the first image by the fourth to sixth nozzles of white W. Moreover, at the third pass, the dots of the second image are formed on the background image by the first to third nozzles of YMCK. The same printing is performed hereinafter, so that in the printable region, it is possible to print the first image on the film sheet S, print the background image on the first image, and print the second image on the background image.

In this instance, although the printing of the front-side print mode has been described, as described above, if the first image and the second image are replaced, the printing of the back-side print mode can be performed. Therefore, the printing of the back-side print mode will node described herein.

Figure 11:
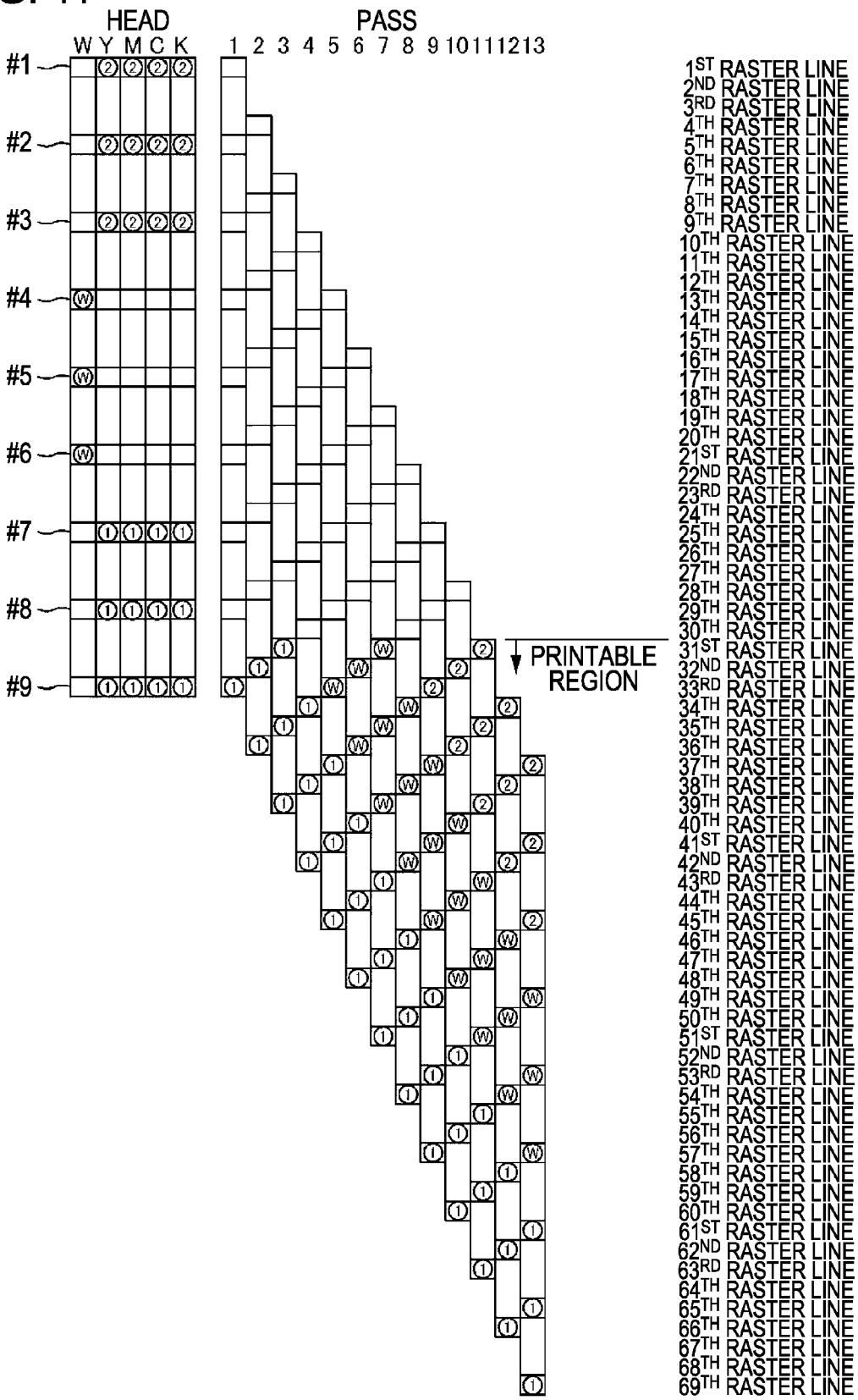
FIG. 11 is a view illustrating interlaced print according to the first embodiment.

FIG. 11 is a view illustrating interlaced print according to the first embodiment. In the figure, the head including the nozzle arrays of white W, yellow Y, magenta M, cyan C and black K is shown. Here, for descriptive convenience, each of the nozzle arrays has 9 nozzles. Further, at the right side of the head, each of the passes is shown to indicate which side the nozzle forms the dots in a raster line.

Here, the nozzle forming the first image is indicated by '1', the nozzle forming the second image is indicated by '2', and the nozzle forming the background image by the white ink is indicated by 'W'. In addition, at the respective passes, the nozzle forming dots of the first image is indicated by '1', the nozzle forming dots of the second image is indicated by '2', and the nozzle forming the background image by the white ink is indicated by 'W'.

Referring to the figure, the printable region exists after the $31^{st}$ raster line. For example, the order of forming the dots will be described by making a note of a $31^{st}$ raster line to a $33^{rd}$ raster line.

At the first pass, the dots of the first image are formed on the $33^{rd}$ raster line on the film sheet S by the ninth nozzles of YMCK. Here, whenever one pass is completed, the film sheet S is transported by ¾ nozzle pitch in the transport direction.

At the second pass, the dots of the first image are formed on the $32^{nd}$ raster line on the film sheet S by the eighth nozzles of YMCK. At the third pass, the dots of the first image are formed on the $31^{st}$ raster line on the film sheet S by the seventh nozzles of YMCK. At the fourth pass, the dots of the first image are formed by the seventh nozzles of YMCK, but the dots are not formed on the raster line, if making a note of the $31^{st}$ raster line to the $33^{rd}$ raster line.

At the fifth pass, the dots of the background image are formed on the $33^{rd}$ raster line on the first image by the sixth nozzles of white W. At the sixth pass, the dots of the background image are formed on the $32^{nd}$ raster line on the first image by the fifth nozzles of white W. At the seventh pass, the dots of the background image are formed on the $31^{st}$ raster line on the first image by the fourth nozzles of white W. At the eighth pass, the dots of the background image are formed by the fourth nozzle of white W, but the dots are not formed on the raster line, if making a note of the $31^{st}$ raster line to the $33^{rd}$ raster line.

At the ninth pass, the dots of the second image are formed on the $33^{rd}$ raster line on the background image by the third nozzles of YMCK. At the tenth pass, the dots of the second image are formed on the $32^{nd}$ raster line on the background image by the second nozzles of YMCK. At the eleventh pass, the dots of the second image are formed on the $31^{st}$ raster line on the background image by the first nozzles of YMCK.

By performing the same printing hereinafter, in the printable region, it is possible to print the first image on the film sheet S, print the background image on the first image, and print the second image on the background image.

In this instance, although the printing of the front-side print mode has been described, if the first image and the second image are replaced, the printing of the back-side print mode is performed. Therefore, the printing of the back-side print mode will node described herein.

Figure 12:
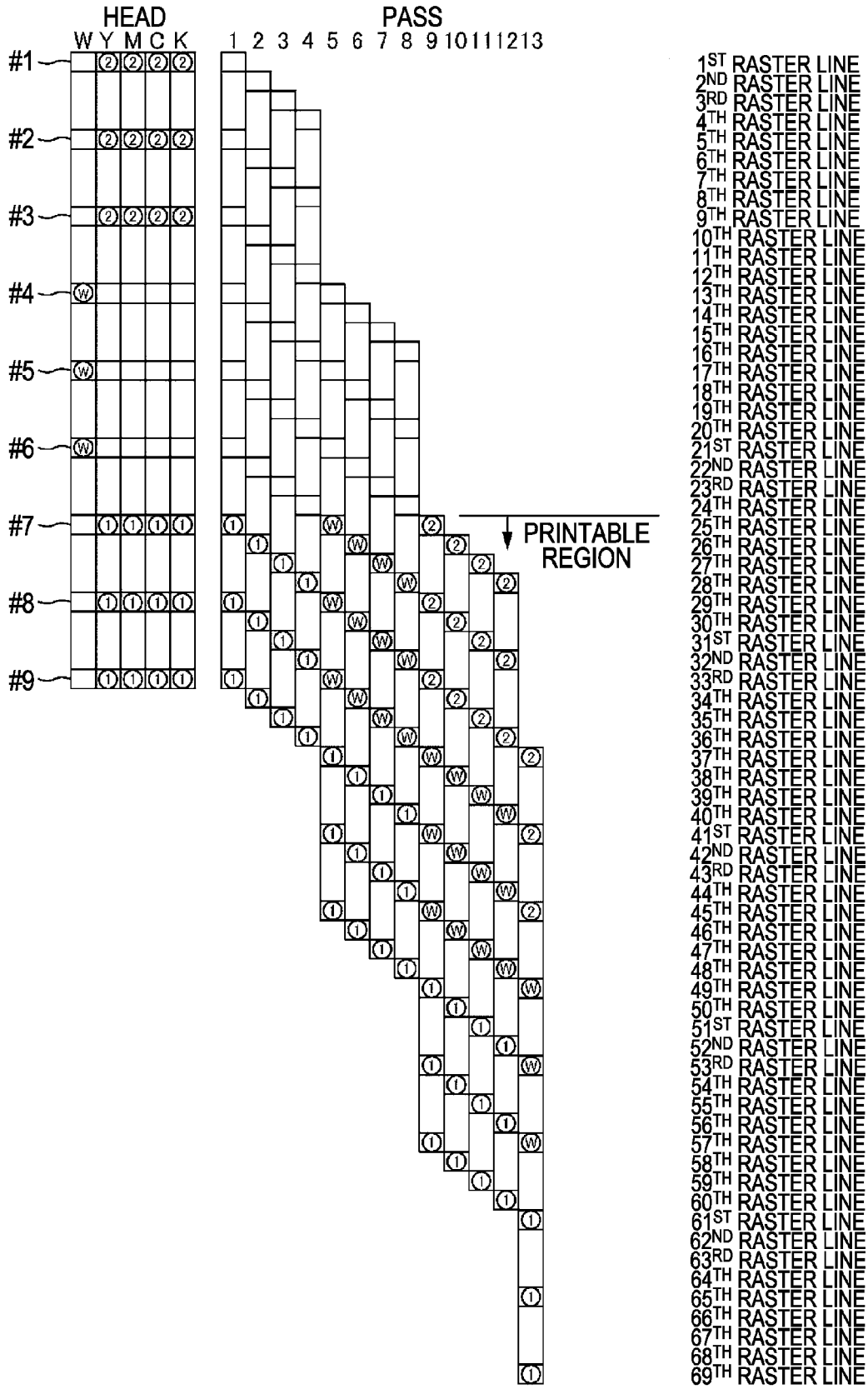
FIG. 12 is a view illustrating microfeed print according to the first embodiment.

FIG. 12 is a view illustrating the microfeed print according to the first embodiment. In the figure, the head including the nozzle arrays of white W, yellow Y, magenta M, cyan C and black K is shown. Here, for descriptive convenience, each of the nozzle arrays has 9 nozzles which are indicated by first to ninth nozzle numbers. Further, at the right side of the head, each of the passes is shown to indicate which side the nozzle forms the dots in a raster line.

Here, the nozzle forming the first image is indicated by '1', the nozzle forming the second image is indicated by '2', and the nozzle forming the background image by the white ink is indicated by 'W'. In addition, at the respective passes, the nozzle forming dots of the first image is indicated by '1', the nozzle forming dots of the second image is indicated by '2', and the nozzle forming dots of the background image by the white ink is indicated by 'W'.

Referring to the figure, the printable region exists after the $25^{th}$ raster line. For example, the order of forming the dots will be described by making a note of the $25^{th}$ raster line to the $28^{th}$ raster line.

At the first pass, the dots of the first image are formed on the $25^{th}$ raster line on the film sheet S by the seventh nozzles of YMCK. Here, whenever one pass is completed, the film sheet S is transported by a ¼ nozzle pitch in the transport direction.

At the second pass, the dots of the first image are formed on the $26^{th}$ raster line on the film sheet S by the seventh nozzles of YMCK. At the third pass, the dots of the first image are formed on the $27^{th}$ raster line on the film sheet S by the seventh nozzles of YMCK. At the fourth pass, the dots of the first image are formed on the $28^{th}$ raster line on the film sheet S by the seventh nozzles of YMCK.

At the fifth pass, the dots of the background image are formed on the $25^{th}$ raster line on the first image by the fourth nozzles of white W. At the sixth pass, the dots of the background image are formed on the $26^{th}$ raster line on the first image by the fourth nozzles of white W. At the seventh pass, the dots of the background image are formed on the $27^{th}$ raster line on the first image by the fourth nozzles of white W. At the eighth pass, the dots of the background image are formed on the $28^{th}$ raster line on the first image by the fourth nozzle of white W.

At the ninth pass, the dots of the second image are formed on the $25^{th}$ raster line on the background image by the first nozzles of YMCK. At the tenth pass, the dots of the second image are formed on the $26^{th}$ raster line on the background image by the fourth nozzles of YMCK. At the eleventh pass, the dots of the second image are formed on the $27^{th}$ raster line on the background image by the fourth nozzles of YMCK. At the twelfth pass, the dots of the second image are formed on the $28^{th}$ raster line on the background image by the fourth nozzles of YMCK.

If the dot formation for 12 passes is performed, the film sheet S is transported by 2 nozzle pitches and ¼ nozzle pitch in the transport direction. The same dot formation as the above description is repeated. In this way, in the printable region, it is possible to print the first image on the film sheet S, print the background image on the first image, and print the second image on the background image.

In this instance, although the printing of the front-side print mode has been described, as described above, if the first image and the second image are replaced, the printing of the back-side print mode is performed. Therefore, the printing of the back-side print mode will node described herein.

As an modified example, one raster may be printed in multiple passes by the nozzles of the same block by putting the nozzles of the same block take in charge of one raster in multiple times.

SECOND EMBODIMENT

Figure 13:
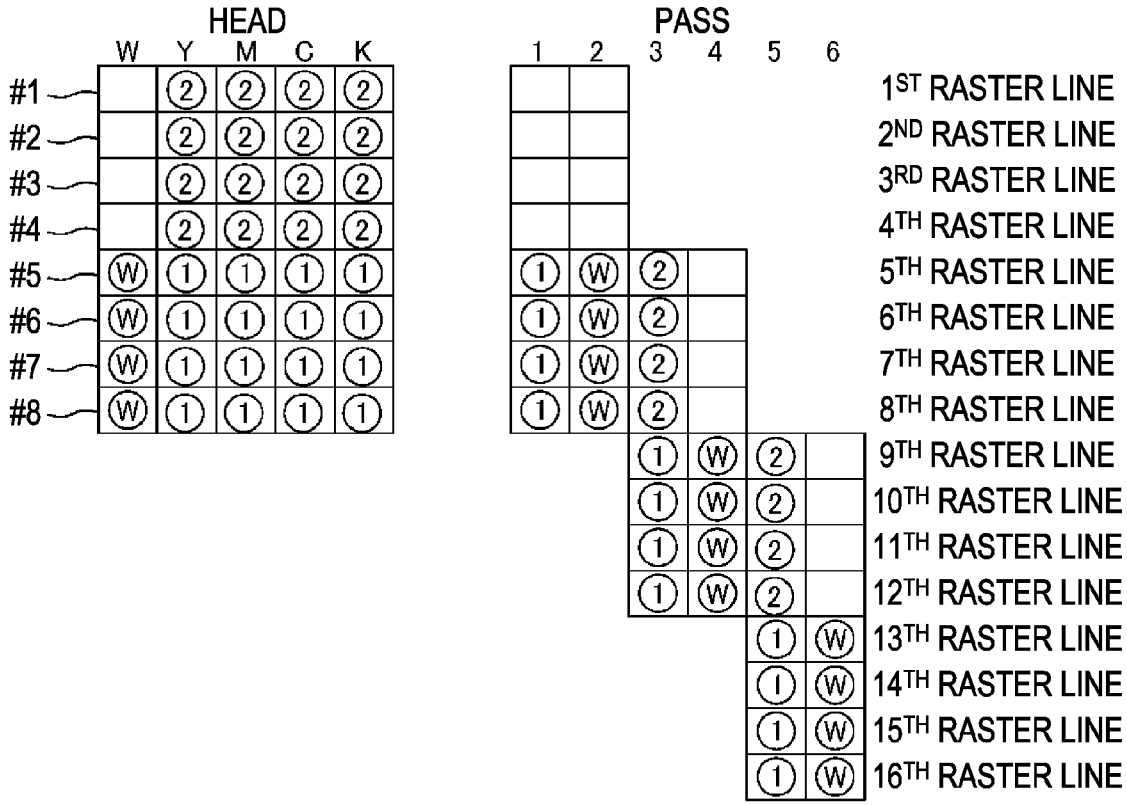
FIG. 13 is a view illustrating band print in a front-side print mode according to a second embodiment.

FIG. 13 is a view illustrating a band print in a front-side print mode according to the second embodiment. In the figure, the head including the nozzle arrays of white W, yellow Y, magenta M, cyan C and black K is shown. Here, for descriptive convenience, each of the nozzle arrays has 8 nozzles which are indicated by first to eighth nozzle numbers. Further, at the right side of the head, each of the passes is shown to indicate which side the nozzle forms the dots in a raster line.

Referring to the figure, the printable region exists after the $5^{th}$ raster line. For example, the order of forming the dots will be described by taking a note of the $5^{th}$ raster line to the $8^{th}$ raster line.

At the first pass, the dots of the first image are formed on the $5^{th}$ raster line to the $8^{th}$ raster line on the film sheet S by the fifth to eighth nozzles of YMCK. Next, the film sheet S is not transported in the transport direction, and at the second pass, the dots of the background are formed on the $5^{th}$ raster line to the $8^{th}$ raster line on the first image by the fifth to eighth nozzles of white ink W. Here, whenever two passes are completed, the film sheet S is transported by 4 nozzle pitches in the transport direction.

At the third pass, the dots of the second image are formed on the $5^{th}$ raster line to the $8^{th}$ raster line on the background image by the first to fourth nozzles of YMCK. In this instance, the dots of first image are formed on the $9^{th}$ raster line to the $12^{th}$ raster line. At the fourth pass, the image is not formed on the $5^{th}$ raster line to $8^{th}$ raster line, but the dots of the background image are formed on the $9^{th}$ raster line to the $12^{th}$ raster line. The film sheet S is transported by 4 nozzle pitches in the transport direction. By repeating the operation of the third to fourth pass, in the printable region, it is possible to print the first image on the film sheet, print the background image on the first image, and print the second image on the background image.

Figure 14:
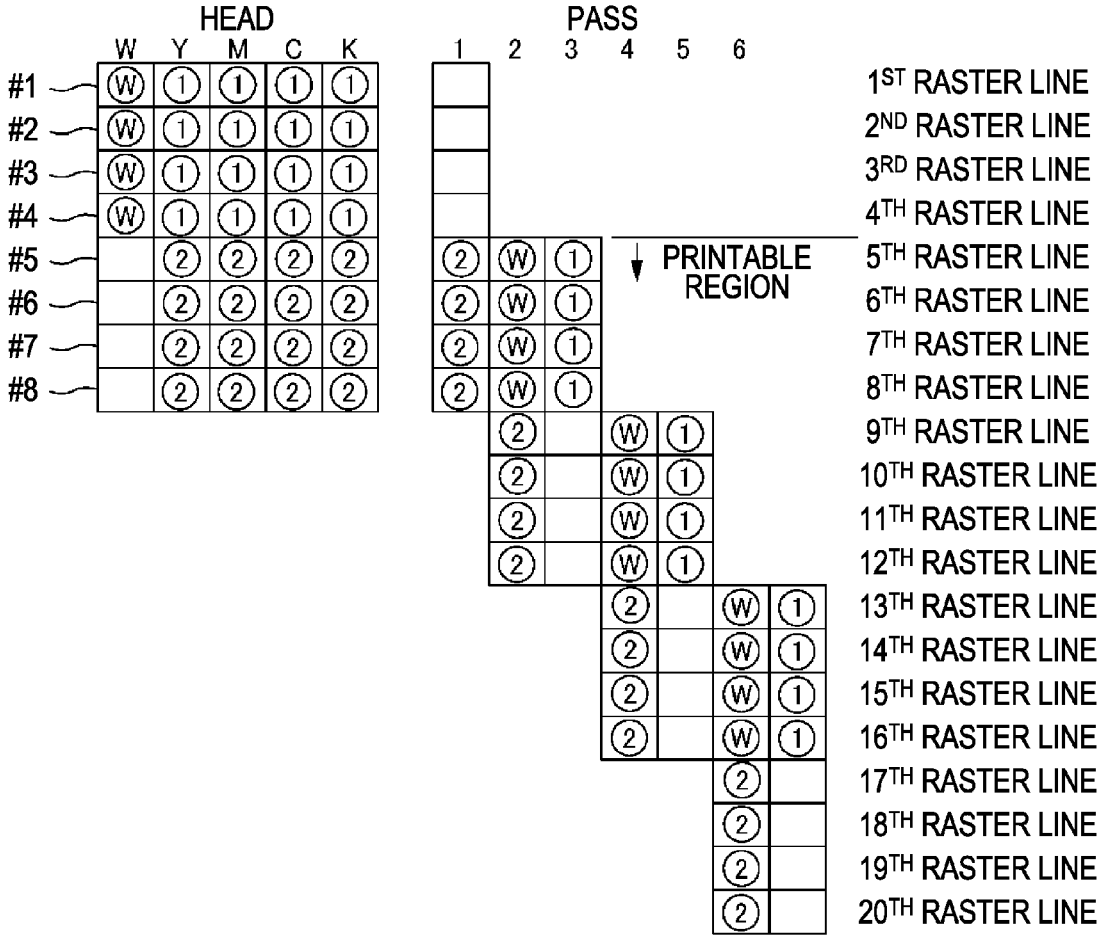
FIG. 14 is a view illustrating band print in a back-side print mode according to the second embodiment.

FIG. 14 is a view illustrating a band print in a back-side print mode according to the second embodiment. Referring to the figure, the printable region exists after the $5^{th}$ raster line. For example, the order of forming the dots will be described by taking a note of the $5^{th}$ raster line to the $8^{th}$ raster line.

At the first pass, the dots of the second image are formed on the $5^{th}$ raster line to the $8^{th}$ raster line on the film sheet S by the fifth to eighth nozzles of YMCK. Next, the film sheet S is transported by 4 nozzle pitches in the transport direction. At the second pass, the dots of the background are formed on the $5^{th}$ raster line to the $8^{th}$ raster line on the first image by the first to fourth nozzles of white ink W. In this instance, the dots of the second image are formed on the $9^{th}$ raster line to the $12^{th}$ raster line on the film sheet S by the fifth to eighth nozzles of YMCK.

Next, the film sheet S is not transported, and at the third pass, the dots are formed. At the third pass, the dots of the first image are formed on the $5^{th}$ raster line to the $8^{th}$ raster line on the background image by the first to eighth nozzles of YMCK. Whenever formation of the dots by combination of the second pass and the third pass are completed, the film sheet S is transported by 4 nozzle pitches in the transport direction.

Hereinafter, by repeating the operation of the second to third passes, in the printable region, it is possible to print the second image on the film sheet, print the background image on the second image, and print the first image on the background image.

In this instance, when the first image is formed, it is possible to print the first image having resolution lower the second image by using the decreased number of nozzles forming the dots.

Figure 15:
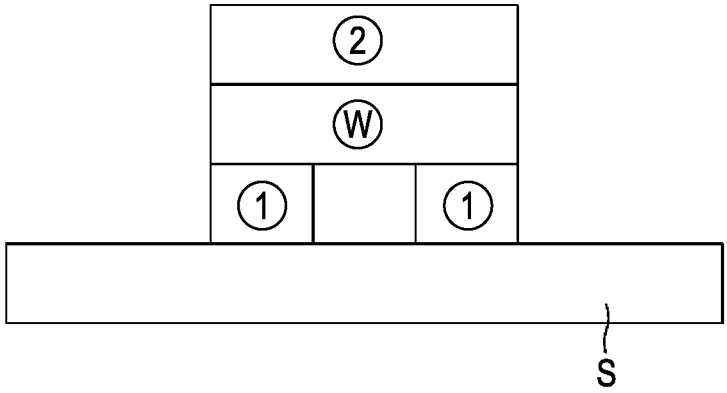
FIG. 15 is a view illustrating overlap of ink of interlaced print in the front-side print mode according to the second embodiment.

FIG. 15 is a view illustrating overlap of the ink of interlaced print in the front-side print mode according to the second embodiment. In the figure, the order of the dots which are formed so as to be overlapped on the film sheet S is shown. Here, as the first image is printed at low resolution as compared with the second image, there is pixel, in which the dots cannot be formed, on the layer on which the first image is formed. It is different from FIG. 8.

Figure 16:
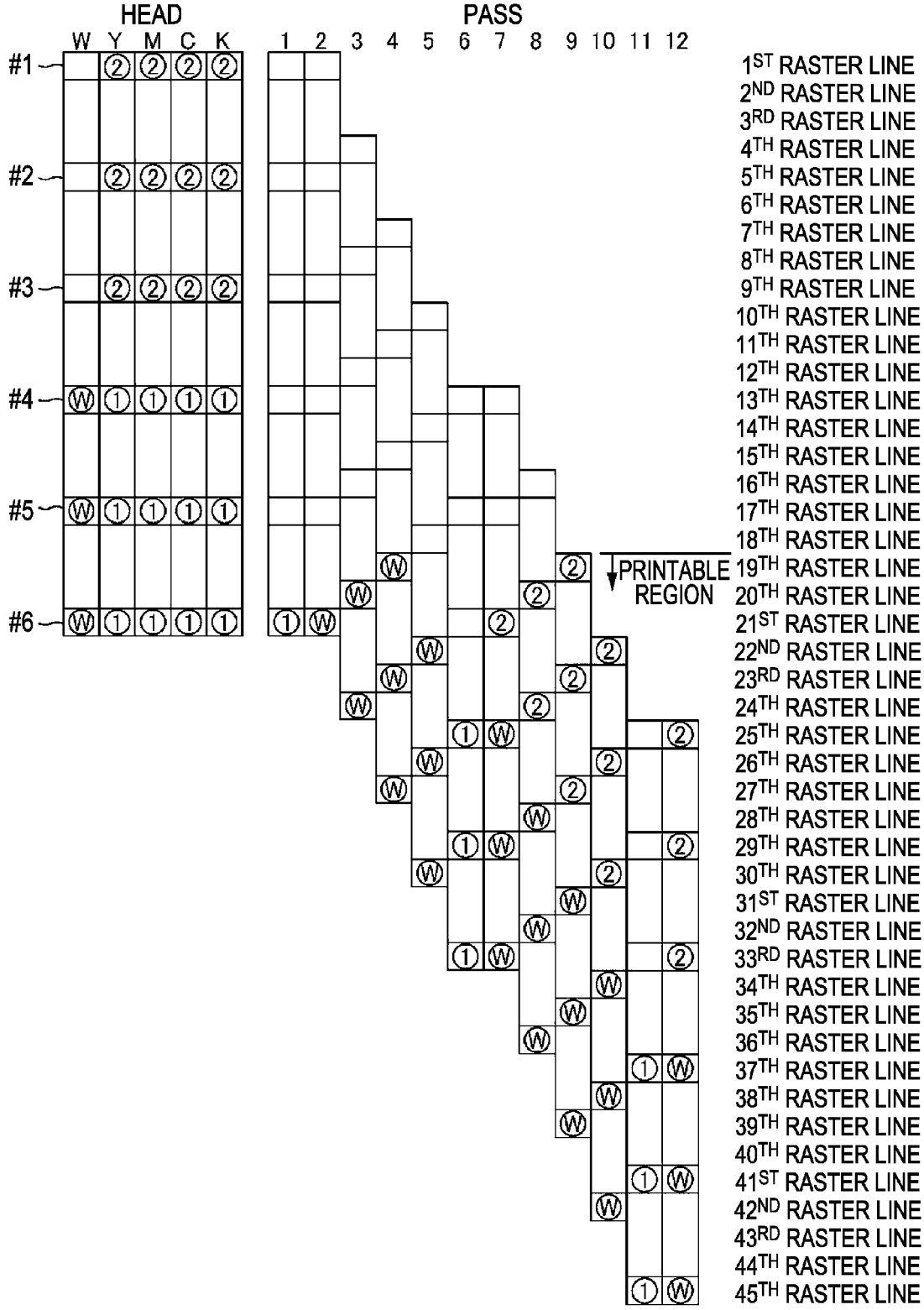
FIG. 16 is a view illustrating interlaced print of a front-side print mode according to the second embodiment.

FIG. 16 is a view illustrating the interlaced print in the front-side print mode according to the second embodiment. In the figure, the head including the nozzle arrays of white W, yellow Y, magenta M, cyan C and black K is shown. Here, for descriptive convenience, each of the nozzle arrays has 6 nozzles which are indicated by first to sixth nozzle numbers.

Referring to the figure, the printable region exists after the $19^{th}$ raster line. For example, the order of forming the dots will be described by making a note of a $19^{th}$ raster line to a $21^{st}$ raster line.

At the first pass, the dots of the first image are formed on the $21^{st}$ raster line on the film sheet S by the sixth nozzles of YMCK. Here, after the dots of the first image are formed, the film sheet S is not transported. At the second pass, the dots of the background image are formed on the $21^{st}$ raster line on the first image by the sixth nozzles of white ink W. Then, the film sheet S is transported by ¾ nozzle pitch.

At the third pass, the dots of the background image are formed on the $20^{th}$ raster line on the film sheet S by the fifth nozzles of white ink W. Then, the film sheet S is transported by ¾ nozzle pitch. At the fourth pass, the dots of the background image are formed on the $19^{th}$ raster line on the film sheet S by the fourth nozzles of white ink W. Then, the film sheet S is transported by ¾ nozzle pitch.

At the fifth pass, the dots of the background image are formed by the fourth nozzles of white ink W, but by taking a note of the $19^{th}$ raster line to the $21^{st}$ raster line, the dots are not formed on these raster lines. At the sixth pass, the dots of the first image are formed by the fourth nozzles of YMCK, but by taking a note of the $19^{th}$ raster line to the $21^{st}$ raster line, the dots are not formed on these raster lines. As described above, since the film sheet S is not transported after the first image is formed, the film sheet S is not transported here.

At the seventh pass, the dots of the second image are formed on the $21^{st}$ raster line on the background image by the third nozzles of YMCK. Then, the film sheet is transported by ¾ nozzle pitch. At the eighth pass, the dots of the second image are formed on the $20^{th}$ raster line on the background image by the second nozzles of YMCK. Then, the film sheet is transported by ¾ nozzle pitch. At the ninth pass, the dots of the second image are formed on the $19^{th}$ raster line on the background image by the first nozzles of YMCK.

Hereinafter, by performing the same printing, in the printable region, it is possible to print the first image on the film sheet S, print the background image on the first image, and print the second image on the background image.

Further, by performing the same printing as the above description, the density of the dots of the first image can be smaller than the density of the dots of the second image, so that it is possible to print the first image having resolution lower than that of the second image.

Figure 17:
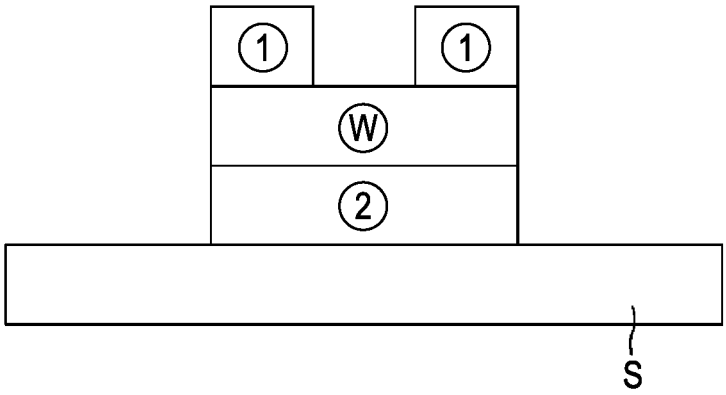
FIG. 17 is a view illustrating overlap of ink of interlaced print in the back-side print mode according to the second embodiment.

FIG. 17 is a view illustrating overlap of the ink of the interlaced print in the back-side print mode according to the second embodiment. In the figure, the order of the dots which are formed so as to be overlapped on the film sheet S is shown. Here, as the first image is printed at low resolution as compared with the second image, there is pixel, in which the dots cannot be formed, on the layer on which the first image is formed. It is different from FIG. 9.

Figure 18:
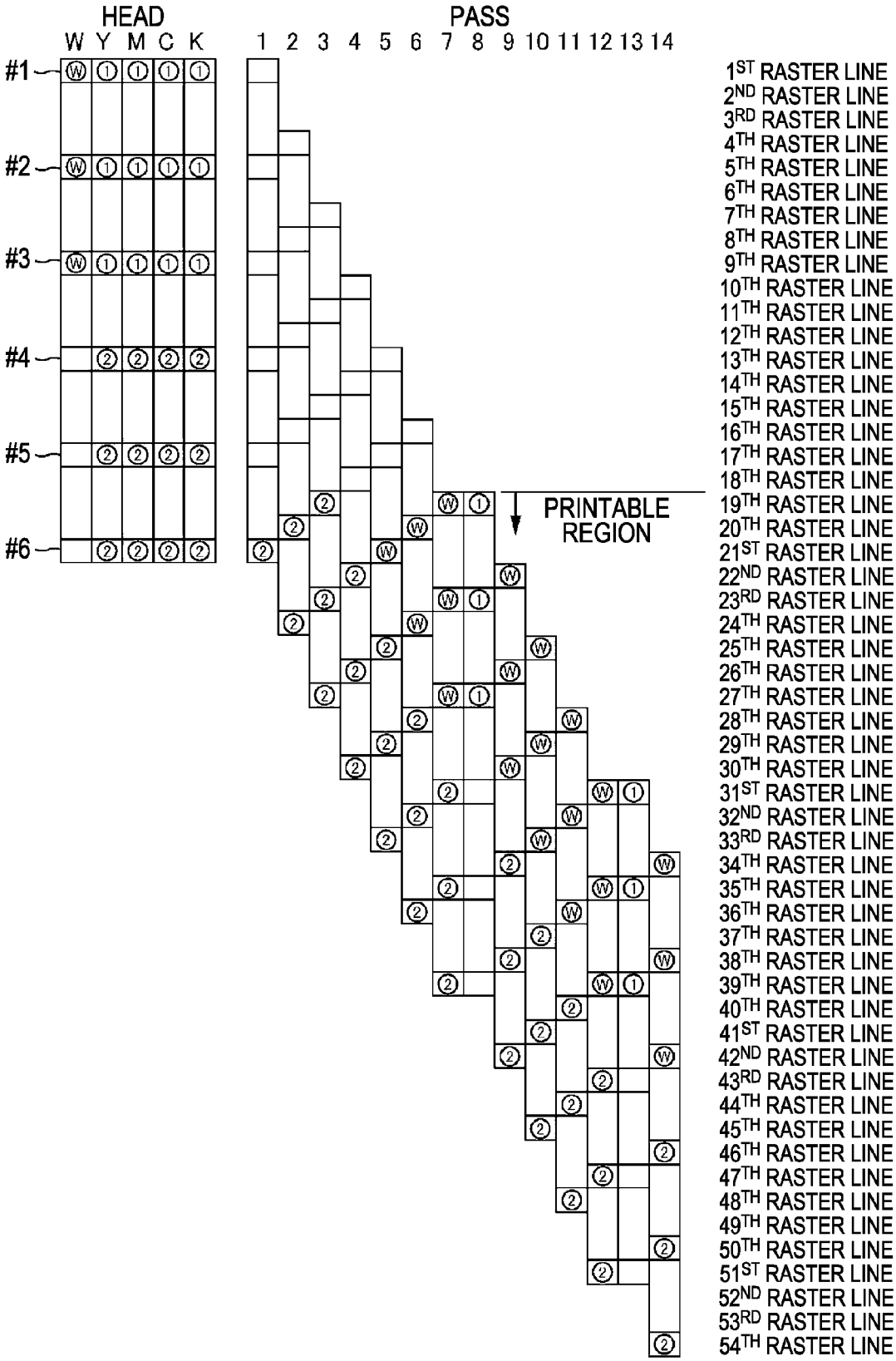
FIG. 18 is a view illustrating the interlaced print of the back-side print mode according to the second embodiment.

FIG. 18 is a view illustrating the interlaced print in the back-side print mode according to the second embodiment. Referring to the figure, the printable region exists after the $19^{th}$ raster line. For example, the order of forming the dots will be described by making a note of a $19^{th}$ raster line to a $21^{st}$ raster line.

At the first pass, the dots of the second image are formed on the $21^{st}$ raster line on the film sheet S by the sixth nozzles of YMCK. Then, the film sheet S is transported by ¾ nozzle pitch. In this instance, till the seventh pass, the film sheet S is transported by ¾ nozzle pitch every pass.

At the second pass, the dots of the second image are formed on the $20^{th}$ raster line on the film sheet S by the fifth nozzles of YMCK. At the third pass, the dots of the second image are formed on the $19^{th}$ raster line on the film sheet S by the fourth nozzles of YMCK. At the fourth pass, the dots of the second image are formed by the fourth nozzles of YMCK, but by taking a note of the $19^{th}$ raster line to the $21^{st}$ raster line, the dots are not formed on these raster lines.

At the fifth pass, the dots of the background image are formed on the $21^{st}$ raster line on the second image by the third nozzles of white ink W. At the sixth pass, the dots of the background image are formed on the $20^{th}$ raster line on the second image by the second nozzles of white ink W. At the seventh pass, the dots of the background image are formed on the $19^{th}$ raster line on the second image by the first nozzles of white ink W. In the back-side print mode according to the second embodiment, the film sheet S is not transported immediately before the first image is formed. Since the first image is formed at the next pass, the film sheet S is not transported.

At the ninth pass, the dots of the first image are formed on the $19^{th}$ raster line on the background image by the first nozzles of YMCK.

Hereinafter, by performing the same printing, in the printable region, it is possible to print the second image on the film sheet S, print the background image on the second image, and print the first image on the background image.

Further, by performing the same printing as the above description, since the density of the dots of the first image can be smaller than the density of the dots of the second image, it is possible to print the first image having resolution lower than that of the second image.

Figure 19:
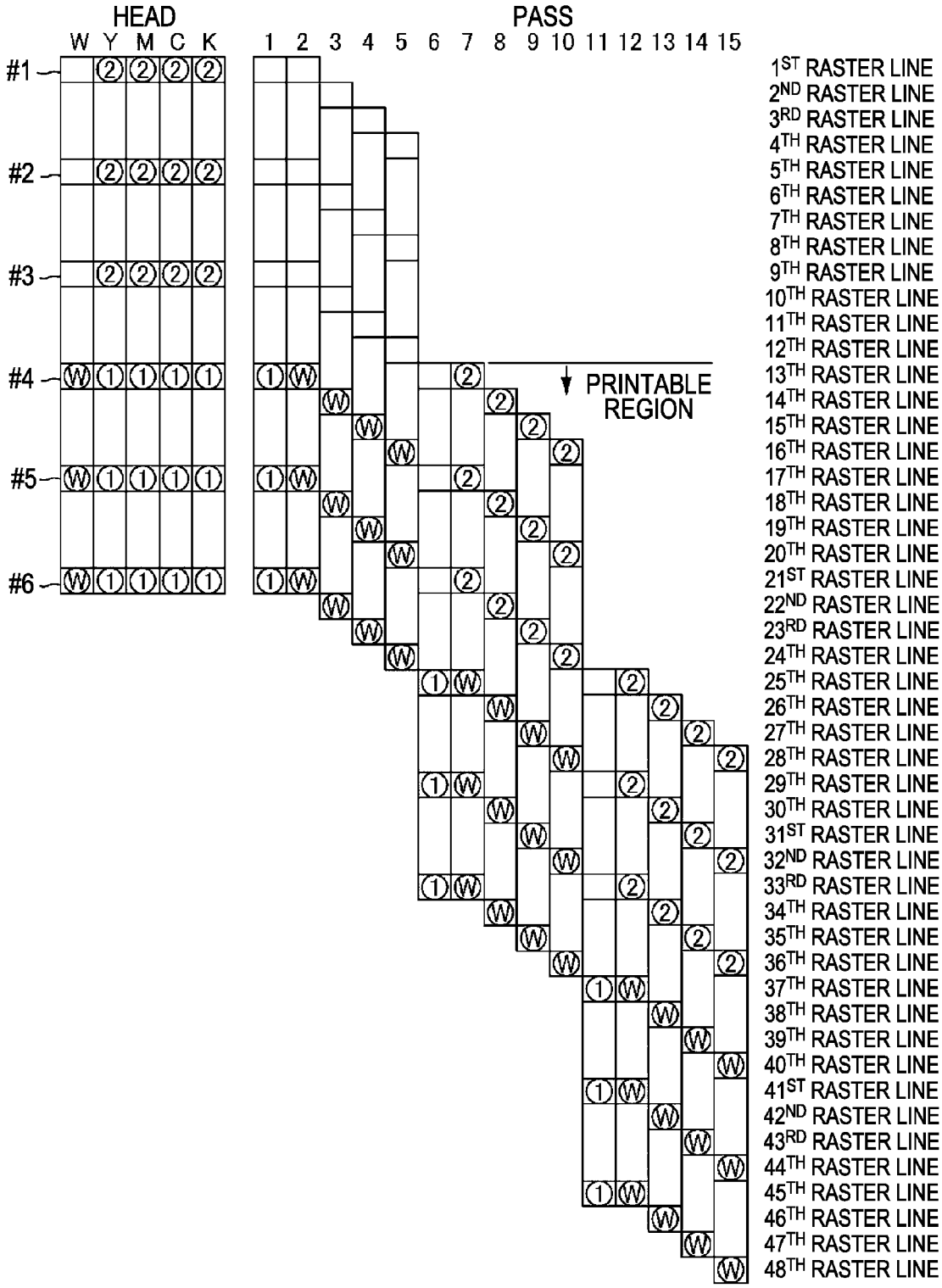
FIG. 19 is a view illustrating microfeed print in the front-side print mode according to the second embodiment.

FIG. 19 is a view illustrating the microfeed print in the front-side print mode according to the second embodiment. In the figure, the head including the nozzle arrays of white W, yellow Y, magenta M, cyan C and black K is shown. Here, for descriptive convenience, each of the nozzle arrays has 6 nozzles which are indicated by first to sixth nozzle numbers.

Referring to the figure, the printable region exists after the $13^{th}$ raster line. In the microfeed print of the front-side print mode according to the second embodiment, the formation of the dots is repeated at the first pass to the tenth pass. Here, the order of forming the dots will be described by making a note of the $13^{th}$ raster line to the $16^{th}$ raster line.

At the first pass, the dots of the first image are formed on the $13^{th}$ raster line on the film sheet S by the fourth nozzles of YMCK. The film sheet S is not transported between the first pass and the second pass. At the second pass, the dots of the background image are formed on the $13^{th}$ raster line on the first image by the fourth nozzles of white ink W. Then, the film sheet S is transported by ¾ nozzle pitch.

At the third pass, the dots of the background image are formed on the $14^{th}$ raster line on the film sheet S by the fourth nozzles of white ink W. The film sheet S is transported by ¾ nozzle pitch every pass between the second pass and the fifth pass. Accordingly, the film sheet S is transported by ¾ nozzle pitch. At the fourth pass, the dots of the background image are formed on the $15^{th}$ raster line on the film sheet S by the fourth nozzles of white ink W. At the fifth pass, the dots of the background image are formed on the $16^{th}$ raster line on the film sheet S by the fifth nozzles of white ink W.

After the fifth pass, the film sheet S is transported by 2 nozzles and ¼ nozzles. At the sixth pass, the dots of the first image are formed by the fourth nozzles of YMCK, but by taking a note of the $13^{th}$ raster line to the $16^{th}$ raster line, the dots are not formed on these raster lines. The film sheet S is not transported between the sixth pass and the seventh pass.

At the seventh pass, the dots of the second image are formed on the $13^{th}$ raster line on the background image by the first nozzles of YMCK. Between the seventh pass and the tenth pass, the film sheet S is transported by ¾ nozzle pitch every pass. At the eighth pass, the dots of the second image are formed on the $14^{th}$ raster line on the background image by the first nozzles of YMCK. At the ninth pass, the dots of the second image are formed on the $15^{th}$ raster line on the background image by the first nozzles of YMCK. At the tenth pass, the dots of the second image are formed on the $16^{th}$ raster line on the background image by the first nozzles of YMCK.

After the tenth pass, the film sheet S is transported by 2 nozzles and ¼ nozzle. Hereinafter, the operation of the first pass to the tenth pass is repeated.

In this way, in the printable region, it is possible to print the first image on the film sheet S, print the background image on the first image, and print the second image on the background image. In this instance, it is possible to lower the density of the dots of the first image than that of the dots of the second image, so that the first image can be printed with resolution lower than the second image.

Figure 20:
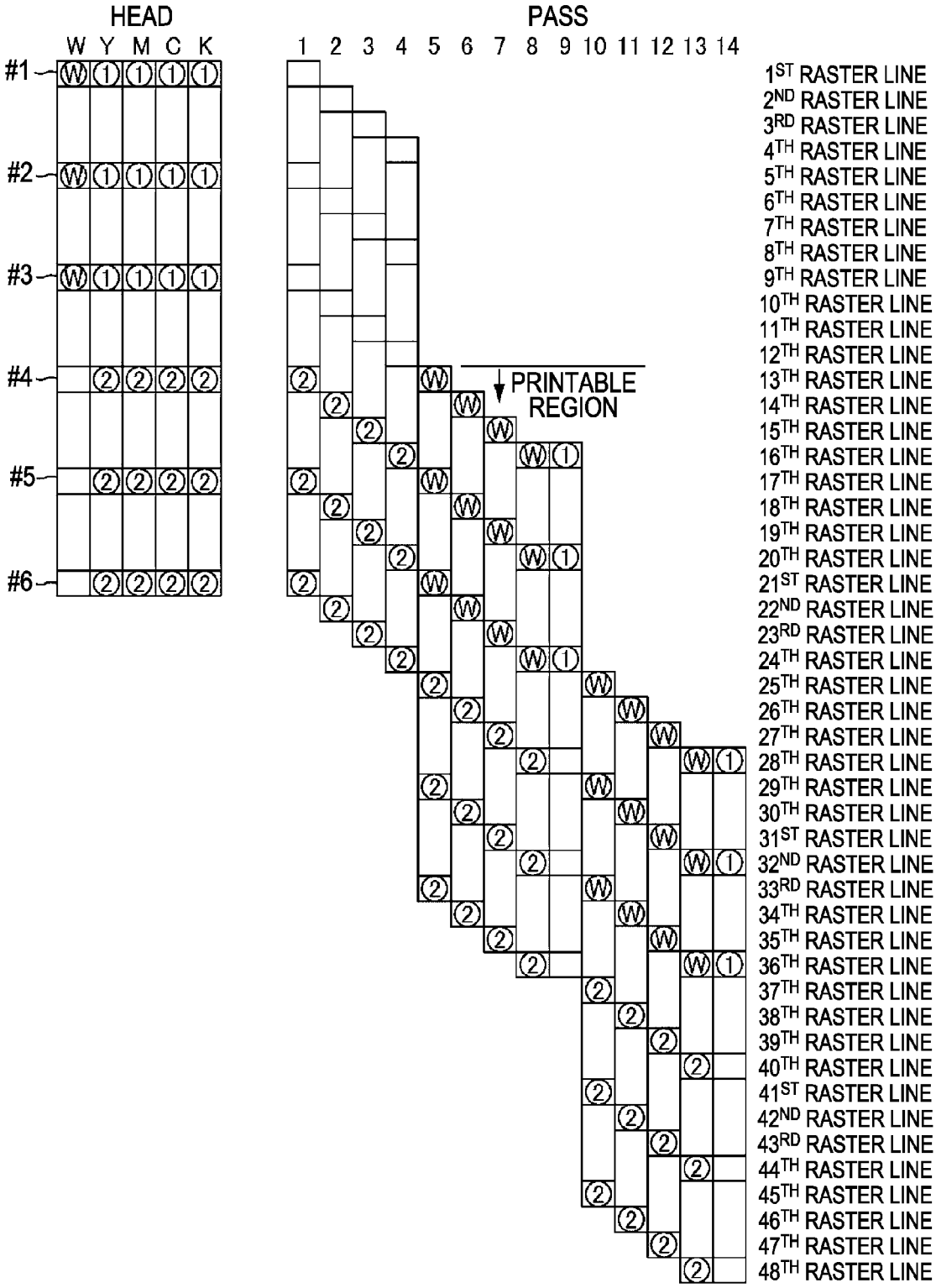
FIG. 20 is a view illustrating microfeed print in the back-side print mode according to the second embodiment.

FIG. 20 is a view illustrating the microfeed print in the back-side print mode according to the second embodiment. Referring to the figure, the printable region exists after the $13^{th}$ raster line. In the microfeed print of the back-side print mode according to the second embodiment, the formation of the dots is repeated at the first pass to the tenth pass. Here, the order of forming the dots will be described by making a note of the $13^{th}$ raster line to the $16^{th}$ raster line.

At the first pass, the dots of the second image are formed on the $13^{th}$ raster line on the film sheet S by the fourth nozzles of YMCK. Between the first pass and the fourth pass, the film sheet S is transported by ¼ nozzle pitch every pass. At the second pass, the dots of the second image are formed on the $14^{th}$ raster line on the film sheet S by the fourth nozzles of YMCK. At the third pass, the dots of the second image are formed on the $15^{th}$ raster line on the film sheet S by the fourth nozzles of YMCK. At the fourth pass, the dots of the second image are formed on the $16^{th}$ raster line on the film sheet S by the fourth nozzles of YMCK.

After the fourth pass, the film sheet S is transported by 2 nozzle pitches and ¼ nozzle pitches.

At the fifth pass, the dots of the background image are formed on the $13^{th}$ raster line on the second image by the first nozzles of white ink W. Between the fifth pass and the eighth pass, the film sheet S is transported by ¼ nozzle pitch every pass. At the sixth pass, the dots of the background image are formed on the $14^{th}$ raster line on the second image by the first nozzles of white ink W. At the seventh pass, the dots of the background image are formed on the $15^{th}$ raster line on the second image by the first nozzles of white ink W. At the eighth pass, the dots of the background image are formed on the le raster line on the second image by the first nozzles of white ink W.

After the eighth pass, the film sheet S is not transported. At the ninth pass, the dots of the first image are formed on the $13^{th}$ raster line on the background image by the first nozzles of YMCK. After the ninth pass, the film sheet S is transported by 2 nozzle pitches and ¼ nozzle pitch. Hereinafter, the operation of the first pass to the ninth pass is repeated.

In this way, in the printable region, it is possible to print the second image on the film sheet S, print the background image on the second image, and print the first image on the background image. In this instance, it is possible to lower the density of the dots of the first image than that of the dots of the second image, so that the first image can be printed with resolution lower than the second image.

THIRD EMBODIMENT

Figure 21:
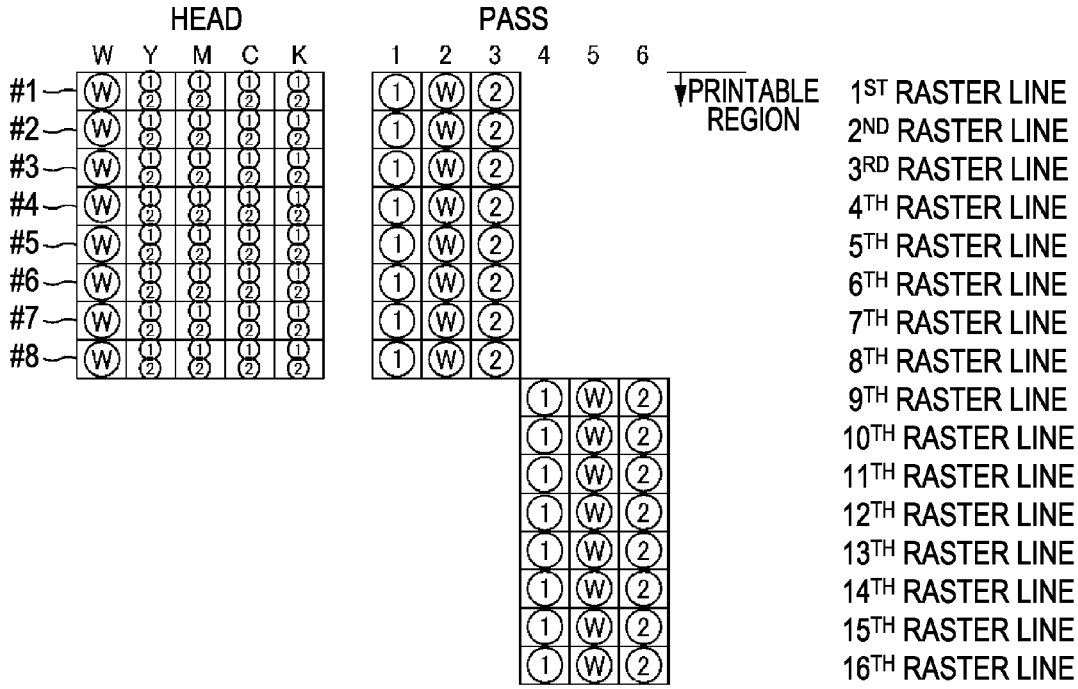
FIG. 21 is a view illustrating band print according to a third embodiment.

FIG. 21 is a view illustrating the band print according to the third embodiment. In the figure, the head including the nozzle arrays of white W, yellow Y, magenta M, cyan C and black K is shown. Here, for descriptive convenience, each of the nozzle arrays has 8 nozzles which are indicated by first to eighth nozzle numbers. Further, at the right side of the head, each of the passes is shown to indicate which side the nozzle forms the dots in a raster line.

At the first pass, the dots of the first image are formed on the $1^{st}$ raster line to the $8^{th}$ raster line on the film sheet S by the first to eighth nozzles of YMCK. Between the first pass and the third pass, the film sheet S is not transported. At the second pass, the dots of the background image are formed on the $1^{st}$ raster line to the $8^{th}$ raster line on the first image by the first to eighth nozzles of white W. At the third pass, the dots of the second image are formed on the $1^{st}$ raster line to the $8^{th}$ raster line on the background image by the first to eighth nozzles of YMCK. After the third pass, the film sheet S is transported by 8 nozzle pitches. Hereinafter, the above-described operation is repeated. In this way, it is possible to print the first image on the film sheet S, print the background image on the first image, and print the second image on the background image.

In this instance, although the printing of the front-side print mode has been described, if the first image and the second image are replaced, as described above, the printing of the back-side print mode can be performed. Therefore, the printing of the back-side print mode will node described herein.

Figure 22:
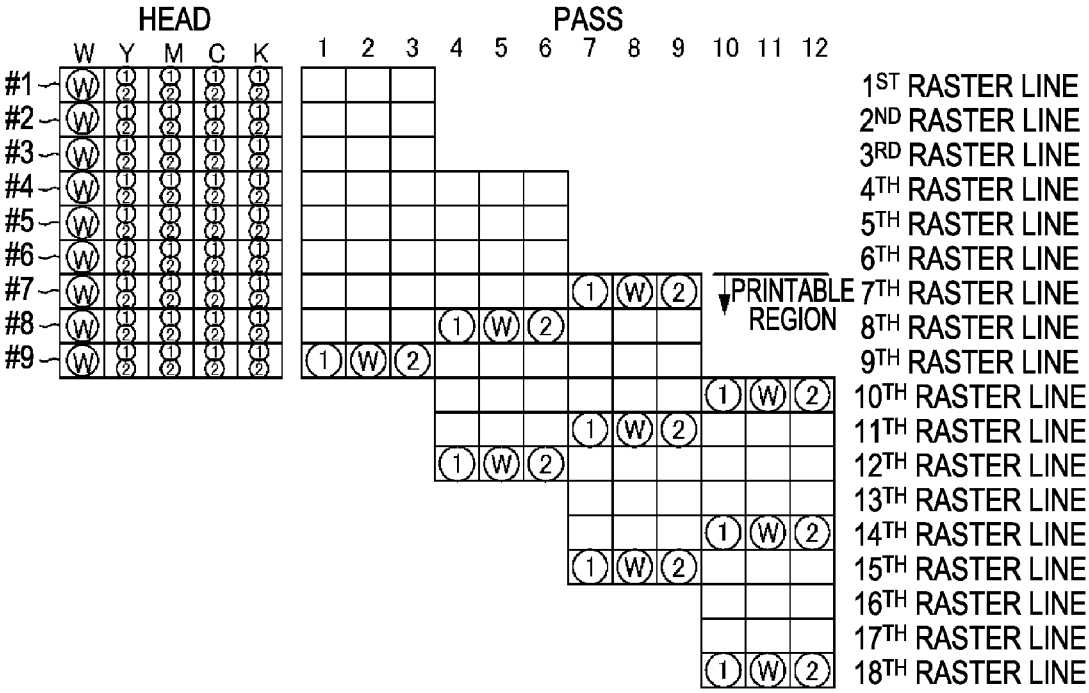
FIG. 22 is a view illustrating interlaced print according to a third embodiment.

FIG. 22 is a view illustrating interlaced print according to the third embodiment. In the figure, the head including the nozzle arrays of white W, yellow Y, magenta M, cyan C and black K is shown. Here, for descriptive convenience, each of the nozzle arrays has 9 nozzles which are indicated by first to ninth nozzle numbers. Further, at the right side of the head, each of the passes is shown to indicate which side the nozzle forms the dots in a raster line.

Referring to the figure, the printable region exists after the $7^{th}$ raster line. In the interlaced print according to the third embodiment, the formation of the dots is repeated at the first pass to the ninth pass. Here, the order of forming the dots will be described by making a note of the $7^{th}$ raster line to the $9^{th}$ raster line.

At the first pass, the dots of the first image are formed on the $9^{th}$ raster line on the film sheet S by the ninth nozzles of YMCK. Between the first pass and the third pass, the film sheet S is not transported. At the second pass, the dots of the background image are formed on the $9^{th}$ raster line on the first image by the ninth nozzles of white ink W. At the third pass, the dots of the second image are formed on the $9^{th}$ raster line on the background image by the ninth nozzles of YMCK. Here, the film sheet S is transported by 3 nozzle pitches every three passes. Accordingly, the film sheet S is transported by 3 nozzle pitches.

At the fourth pass, the dots of the first image are formed on the $8^{th}$ raster line on the film sheet S by the fifth nozzles of YMCK. Between the fourth pass and the sixth pass, the film sheet S is not transported. At the fifth pass, the dots of the background image are formed on the $8^{th}$ raster line on the first image by the fifth nozzles of white ink W. At the sixth pass, the dots of the second image are formed on the $8^{th}$ raster line on the background image by the fifth nozzles of YMCK. The film sheet S is transported by 3 nozzle pitches.

At the seventh pass, the dots of the first image are formed on the $7^{th}$ raster line on the film sheet S by the first nozzles of YMCK. Between the seventh pass and the ninth pass, the film sheet S is not transported. At the eighth pass, the dots of the background image are formed on the $7^{th}$ raster line on the first image by the first nozzles of white W. At the ninth pass, the dots of the second image are formed on the $7^{th}$ raster line on the background image by the first nozzles of YMCK. The film sheet S is transported by 3 nozzle pitches. Hereinafter, the operation of the first pass to the ninth pass is repeated.

In this way, it is possible to print the first image on the film sheet S, print the background image on the first image, and print the second image on the background image.

In this instance, although the printing of the front-side print mode has been described, as described above, if the first image and the second image are replaced, the printing of the back-side print mode can be performed. Therefore, the printing of the back-side print mode will node described herein.

Figure 23:
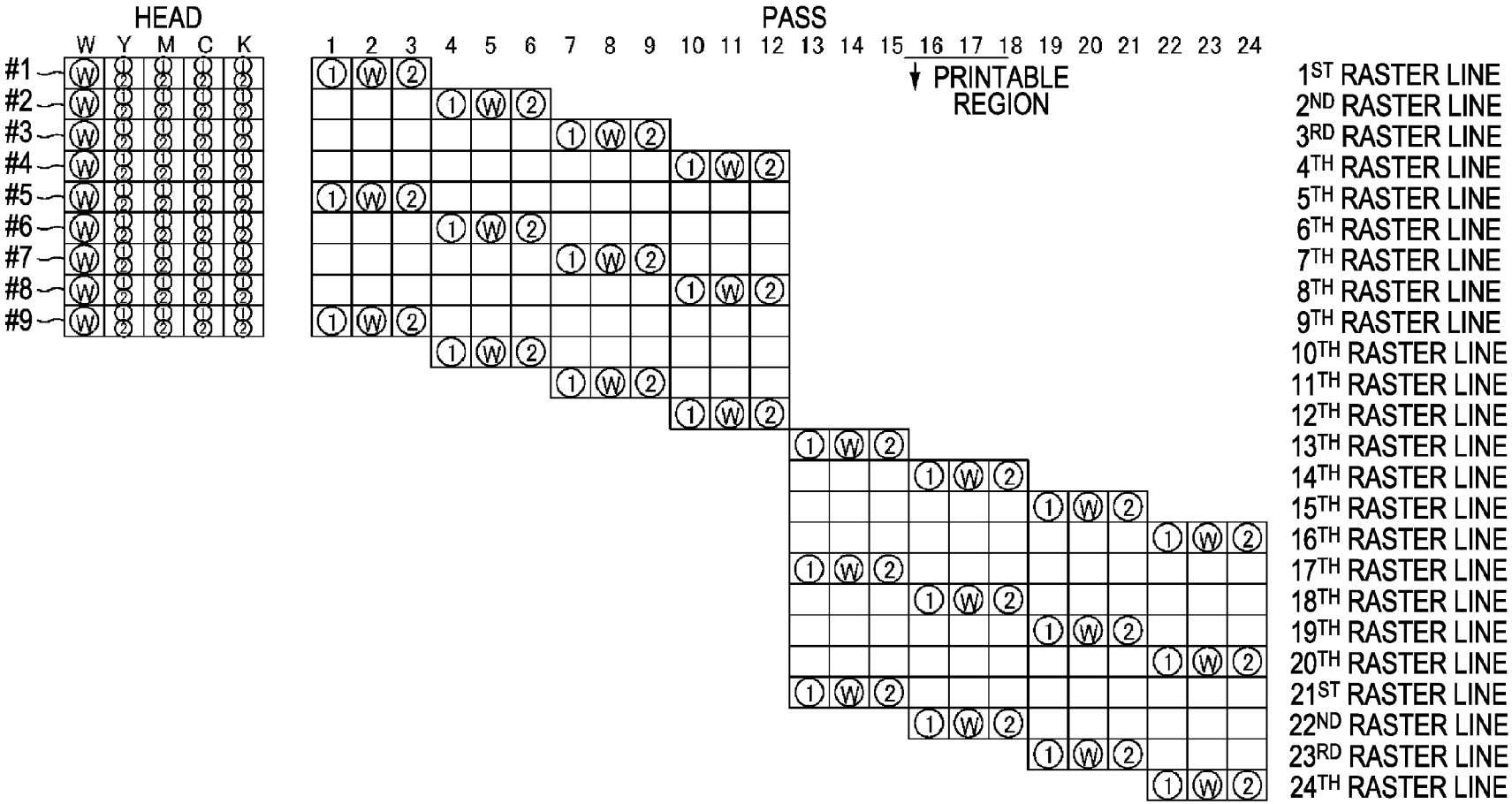
FIG. 23 is a view illustrating microfeed print according to a third embodiment.

FIG. 23 is a view illustrating the microfeed print according to the third embodiment. Here, for descriptive convenience, each of the nozzle arrays has 9 nozzles which are indicated by first to ninth nozzle numbers.

At the first pass, the dots of the first image are formed on the $1^{st}$ raster line on the film sheet S by the first nozzles of YMCK. Between the first pass and the third pass, the film sheet S is not transported. At the second pass, the dots of the background image are formed on the $1^{st}$ raster line on the first image by the first nozzles of white ink W. At the third pass, the dots of the second image are formed on the $1^{st}$ raster line on the background image. The film sheet S is transported by 1 nozzle pitch.

The operation of the first pass to the third pass is repeated at the fourth pass to the twelfth pass. In this way, the printing of the $1^{st}$ raster line to the $4^{th}$ raster line is performed. After the twelfth pass, the film sheet S is transported by 9 nozzle pitches. Hereinafter, the operation of the first pass to the twelfth pass is repeated.

In this way, it is possible to print the first image on the film sheet S, print the background image on the first image, and print the second image on the background image.

In this instance, although the printing of the front-side print mode has been described, if the first image and the second image are replaced, the printing of the back-side print mode can be performed. Therefore, the printing of the back-side print mode will node described herein.

FOURTH EMBODIMENT

Figure 24:
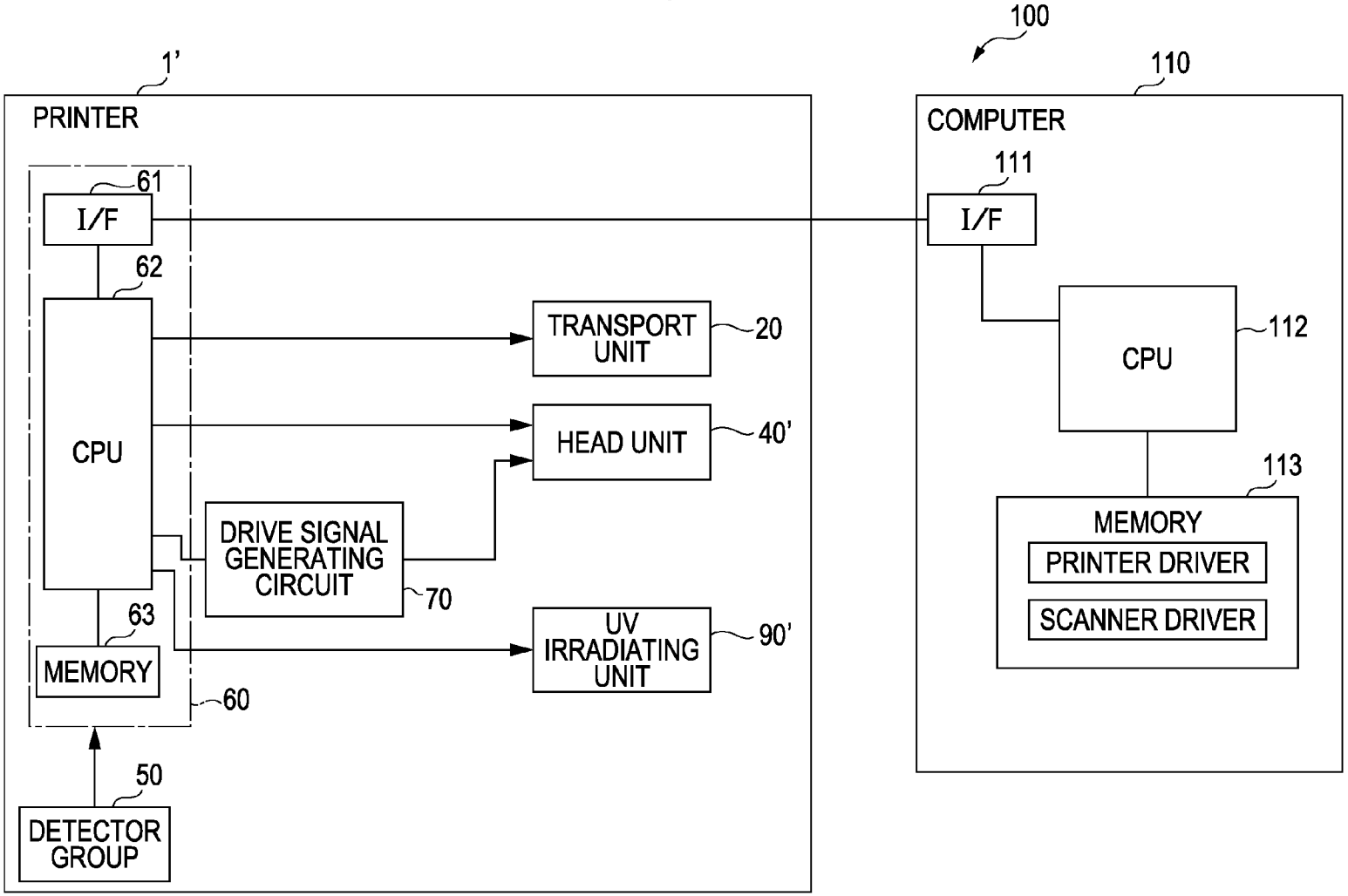
FIG. 24 is a block diagram illustrating the configuration of a print system including a line printer.

FIG. 24 is a block diagram illustrating the configuration of a print system 100 including a line printer 1'. The head unit is fixed to the line printer 1', which is different from the ink jet printer 1 of a serial type. The image is formed by ejecting the ink from the head unit, while the film sheet S is transported in the transport direction. Therefore, the carriage unit 30 for moving the head is not shown in FIG. 24.

Figure 25:
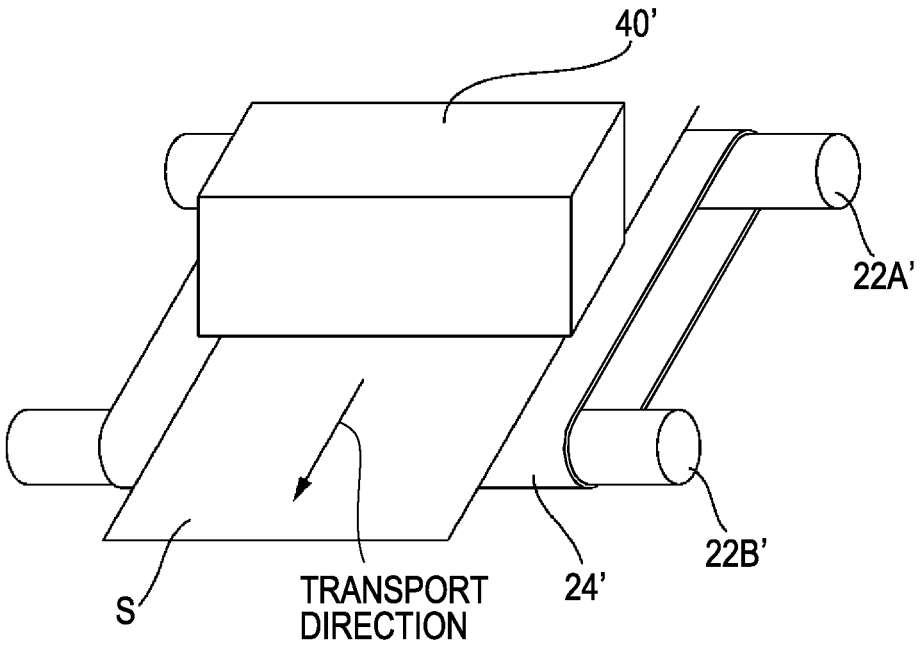
FIG. 25 is a perspective view of the line printer.

FIG. 25 is a perspective view of the line printer V. In the figure, a head unit 40', a belt 24' for transporting the film sheet S, an upstream side transport roller 22A', and a downstream side transport roller 22B' are shown. As shown in the figure, the line printer 1' transports the film sheet S by the belt 24' which can be moved by the transport roller in the transport direction.

Figure 26:
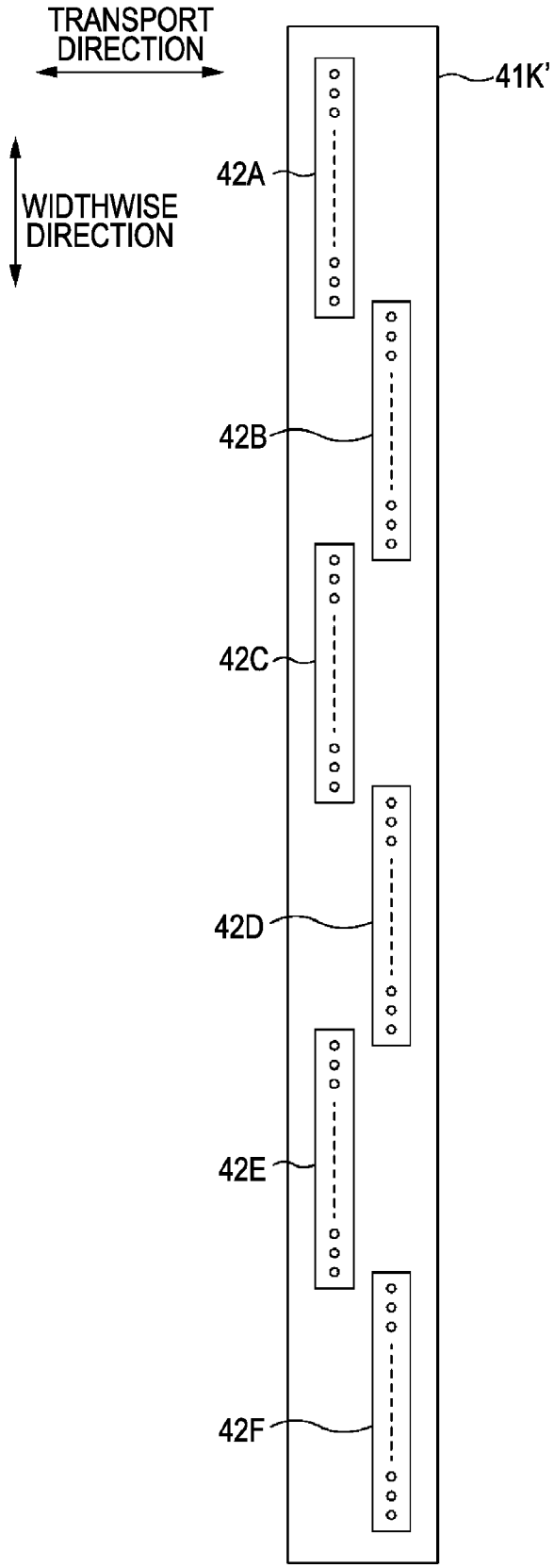
FIG. 26 is a view of a nozzle array unit in the line printer.

FIG. 26 is a view of a nozzle array unit 41' in the line printer 1'. The head unit 40' of the line printer 1' is constituted by a plurality of nozzle array units 41' having a plurality of nozzle arrays each corresponding to one color. Here, the nozzle array unit 41K' of black K is shown, but the same nozzle array unit 41' is provided for yellow Y, magenta M, cyan C and white W.

Each of the nozzle array units 41' has first nozzle array 42A to sixth nozzle array 42F. As shown in the figure, it is possible to perform the printing once with respect to the overall region of the film sheet S in the widthwise direction, by disposing the plurality of nozzle arrays in a zigzag pattern.

Figure 27:
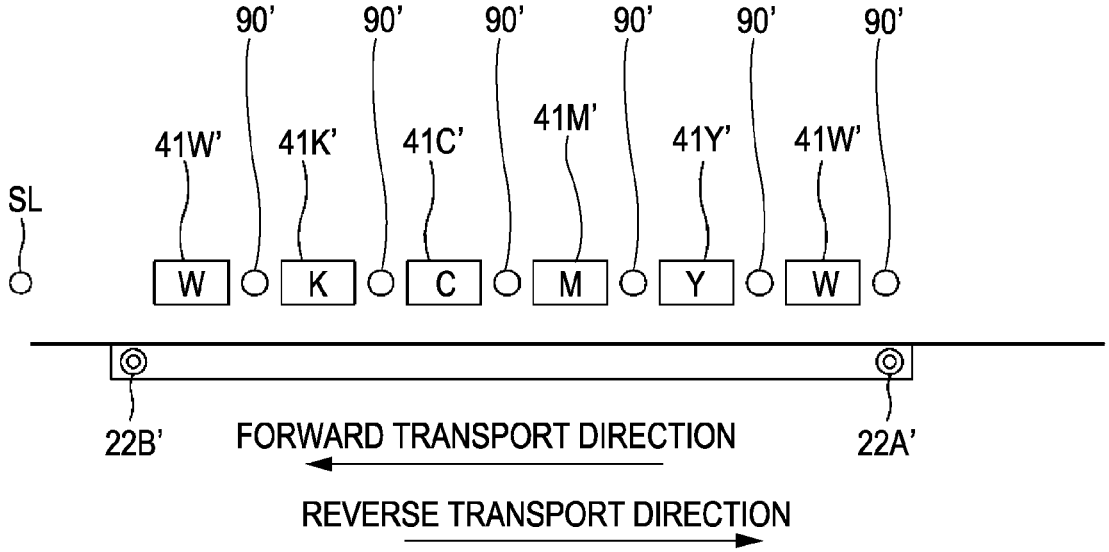
FIG. 27 is a view illustrating the printing in the line printer.

FIG. 27 is a view illustrating the printing in the line printer 1'. In the figure, a UV irradiation unit 90' installed between the nozzle array unit 41' of each color and the respective nozzle array unit is shown. The UV irradiation unit 90' has an LED which can irradiate ultraviolet rays. After each ink is ejected, the dots on the film sheet S are irradiated by the ultraviolet rays, and thus the ink is cured. In this instance, reference numeral SL designated at the left end in the figure denotes a UV irradiation unit for intensive irradiation which is installed to irradiate ultraviolet rays at the final treatment step of the printing to cure all ink.

With the above configuration, as the film sheet S is transported in a forward transport direction, the ink is ejected from each nozzle of YMCK to form the first image. As the film sheet S is transported in a reverse transport direction, the ink is ejected from the nozzle of white ink W to form the background image. Further, as the film sheet S is again transported in the forward transport direction, the ink is ejected from each nozzle of YMCK to form the second image.

In this way, it is possible to print the first image on the film sheet S, print the background image on the first image, and print the second image on the background image.

In this instance, one head of white W may be installed, and two pairs of YMCK color heads may be installed at the upstream side and the downstream side in the transport direction, with the head of white W being interposed between the pairs of the YMCK color heads. Then, the first image may be printed by using the YMCK color head at the upstream side, and the second image may be printed by using the YMCK color head at the downstream side. In this way, by replacing the first image and the second image, it is possible to perform the print in two modes in one transport direction only.

OTHER EMBODIMENTS

While the printer 1 is described as one example of the apparatus, it is not limited thereto. That is, the invention may be applied to an apparatus that ejects a liquid (a fluid, a fluid state containing particles of functional material, or fluidized substance such as gel) other than ink. For example, the same technique as the embodiments can be applied to various kinds of liquid ejecting apparatuses having an application of ink jet technology, such as a color-filter fabricating apparatus, a dying apparatus, a fine machining apparatus, a semiconductor fabricating apparatus, a surface machining apparatus, a 3D modeling device, an evaporator, an organic EL fabricating apparatus (in particular, a polymer EL fabricating apparatus), a display fabricating apparatus, a film forming apparatus, or a DNA chip fabricating apparatus. Further, these methods of fabricating methods are in the category of application range.

While the printer is described as one embodiment, the above embodiments are intended not to definitively interpret the invention but to easily understand it. It is apparent to those skilled in the art that the invention can be modified and varied, without deviating from its teachings, and includes its equivalent. In particular, embodiments described below are contained in the invention.

As to the Head

In the above embodiments, the ink is ejected by using the piezoelectric element. However, the method for ejecting the liquid is not limited thereto. For example, other methods, such as a method for generating bubbles in the nozzle by using heat, may be used.

The entire disclosure of Japanese Patent Application No. 2009-070613, filed Mar. 23, 2009 is expressly incorporated by reference herein.

What is claimed is:

1. An apparatus for printing an image on a transparent medium based on a selected mode, the apparatus comprising:

a transport unit that transports the transparent medium in a transport direction, a head that ejects UV curable ink droplets from a plurality of nozzles, wherein the plurality of nozzles are arranged on the print head in the transport direction at a predetermined pitch;

one or more UV irradiation units and a controller that controls the head to print images by ejecting ink droplets from the nozzles to form dots on the transparent medium when positioned over a platen, the controller having a non-transitory memory with programming recorded thereon configured for printing according to a first printing mode and a second printing mode, the first printing and second printing mode selectable through a user interface, wherein when the first mode is selected, the head prints a first image on the transparent medium, prints a background image on the first image, and prints a second image which is different from the first image on the background image, and wherein when the second mode is selected, the head prints a second image on the transparent medium, prints a background image on the second image, and prints a first image on the background image wherein the printhead and transport unit are configured for microfeed printing in which the transport unit transports the transparent medium in the transport direction a distance less than the pre-determined pitch of the plurality of nozzles.

2. The apparatus according to claim 1, wherein in the first mode, a mirror image of the first image is printed, and simultaneously, an actual image of the second image is printed, and in the second mode, a mirror image of the second image is printed, and simultaneously, an actual image of the first image is printed.

3. The apparatus according to claim 1, wherein the controller is configured to convert image data of the first image and second image into print data of the first and image and second image such that the first image is an additive image having an area of printing that is smaller than that of the second image when printed, the first mode is a front-beat print mode in which the second image is positioned closer to the head than the additive image in a printing completion state, and the second mode is a back-beat print mode in which the additive image is positioned closer to the head than the second image in the printing completion state.

4. The apparatus according to claim 3, wherein print resolution of the additive image is lower than that of the second image.

5. The apparatus according to claim 1, wherein the head includes a nozzle for ejecting ink droplets of a predetermined background color in order to print the background image with the predetermined background color.

6. The apparatus according to claim 5, wherein the head is guided in a moving direction intersecting with the transport direction;

the image is printed by repeating a transport operation in which the transparent medium is transported in the transport direction by the transport unit, and a dot formation operation in which the ink droplets are ejected from the nozzles to form dots on the transparent medium while the head is moved in the moving direction; and the resolution is resolution in the transport direction.

7. The apparatus according to claim 1, further comprises a moving mechanism that moves a relative position of the transparent medium and the head in a direction intersecting with a nozzle line direction in which the nozzles are arranged in parallel with each other.

8. A method for printing an image on a transparent medium using the apparatus according to claim 1, the method comprising:

selecting the first mode, wherein the head prints a first image on the transparent medium, prints a background image on the first image, and prints a second image which is different from the first image on the background image, and selecting the second mode, wherein the head prints a second image on the transparent medium, prints a background image on the second image, and prints a first image on the background image microfeed printing the first image by transporting the transparent medium a distance less than a pre-determined pitch at which a plurality of ink ejection nozzles are arranged on the head.

9. The apparatus according to claim 1, wherein the apparatus is configured such that the first image, the background or the second image are printed by the head unit ejecting ink on a pass across the transparent medium while the UV irradiation unit cures the ejected ink of the first image, the background, or the second image, respectively, on a return stroke such that each of the first image, the background and the second image can be printed on the transparent medium according to the first or second mode while the transparent medium remains positioned on the platen.

10. The apparatus of claim 1, wherein the controller is configured to convert image data of the first image and second data into first image print data and second image print data, respectively, such that, in each of the first and second mode, a print resolution of the first image print data is lower than that of the second image print data.

11. The apparatus of claim 10, wherein the first image print data is an additive image when printed with the second image print data.

12. The apparatus of claim 10, wherein the controller is further configured such that the print data of the second image and the first image having lower resolution includes a pixel in which dots cannot be formed in a layer in which the first image is formed and can be formed in a layer in which the second image is formed.

13. The apparatus of claim 10, wherein the modes are configured such that the first image is formed by microfeed print so that the print resolution of the first image is lower than that of the second image.

* * * * *